US006196393B1

(12) United States Patent
Kruk, Jr. et al.

(10) Patent No.: US 6,196,393 B1
(45) Date of Patent: Mar. 6, 2001

(54) EXTRACTION AND SCANNING SYSTEM

(75) Inventors: Robert R. Kruk, Jr., Crestwood, IL (US); Bruce T. Macauley, Newport Beach, CA (US)

(73) Assignee: Inscerco Mfg., Inc., Crestwood, IL (US)

( * ) Notice: Subject to any disclaimer, the term of this patent is extended or adjusted under 35 U.S.C. 154(b) by 0 days.

(21) Appl. No.: 09/285,924

(22) Filed: Apr. 2, 1999

(51) Int. Cl.[7] ..... B07C 5/00; B65B 43/26

(52) U.S. Cl. ..... 209/630; 209/900; 209/942; 53/381.3; 53/492

(58) Field of Search ..... 209/3, 630, 583, 209/584, 587, 900, 942; 53/381.3, 381.5, 381.6, 492

(56) References Cited

U.S. PATENT DOCUMENTS

| | | | |
|---|---|---|---|
| 414,886 | 11/1889 | Morse | 53/381.3 |
| 2,992,629 | 7/1961 | Belopavlovich, Jr. | 53/381.3 |
| 3,238,926 | 3/1966 | Huck | 53/381 |
| 3,613,315 | 10/1971 | Schickling | 53/381 |
| 3,943,807 | 3/1976 | Bingham et al. | 83/79 |
| 4,124,968 | 11/1978 | Stevens et al. | 53/381 |
| 4,809,340 | 2/1989 | Mersereau | 382/1 |
| 4,893,454 | 1/1990 | Russell | 53/492 |
| 4,926,729 | 5/1990 | Igarashi | 83/364 |
| 4,934,892 | 6/1990 | Smith et al. | 414/412 |
| 4,998,626 | 3/1991 | Ota | 209/584 |
| 5,054,620 | 10/1991 | DeWitt et al. | 209/3.1 |
| 5,310,062 * | 5/1994 | Stevens et al. | 209/584 |
| 5,363,967 * | 11/1994 | Tilles et al. | 209/900 X |
| 5,737,438 | 4/1998 | Zlotnick et al. | 382/101 |
| 5,810,173 | 9/1998 | Stevens et al. | 209/539 |
| 5,842,577 | 12/1998 | Stevens et al. | 209/3.3 |
| 5,842,693 | 12/1998 | Stevens et al. | 271/4.01 |

FOREIGN PATENT DOCUMENTS

| | | | |
|---|---|---|---|
| 6-170339 * | 6/1994 | (JP) | 209/584 |

* cited by examiner

*Primary Examiner*—Tuan N. Nguyen
(74) *Attorney, Agent, or Firm*—Olson & Hierl, Ltd.

(57) ABSTRACT

A stand-alone method and system is provided for processing the contents of a plurality of envelopes, and includes at least an opening device, an image acquisition device and a control device. The opening device opens the envelopes on at least one side forming opened envelopes, thereby exposing the contents thereof for extraction. The image acquisition device is in operable communication with the opening device and is used to acquire an image of the contents and store that image in digital form in a file. Finally, the control device is operably connected to at least the opening device and image acquisition device, whereby when the image of the contents are acquired from one envelope, a next envelope is opened and a new file is created.

70 Claims, 16 Drawing Sheets

EXTRACTION AND SCANNING SYSTEM

TECHNICAL FIELD OF THE INVENTION

This invention relates to a system and method for extracting the contents of envelopes, and particularly to opening mixed sized envelopes, and extracting the mixed and varying sized documents contained therein and scanning them into a database for image document processing.

BACKGROUND OF THE INVENTION

The amount of mail received by businesses and federal, state and local government agencies continues to grow daily. For example, the large volumes of remittance mailings received by utility companies, department stores and other retail enterprises, banks and other lending institutions, insurance companies, credit card companies, etc., just to name a few, demonstrate the need for efficient handling of large volumes of incoming mail. Moreover, the U.S. Post Office indicates that daily volumes of such mailings will continue to increase appreciably in the near future. The use of an automated, high speed remittance processors is an essential component of any efficient office procedure for handling such large bulk volumes of remittance mailings.

The contents of each envelope are generally referred to as a transaction, and may consist of one or more documents including one or more invoices and/or one or more checks. The most common transaction consists of a single invoice stub (remit) and an accompanying payment check.

According to conventional methods of automated or semi-automated remittance processing, the contents, such as an invoice and an accompanying check, are processed by opening the envelope, extracting the contents from the envelope, placing the contents in the proper sequence and orientation, and then stacking the contents into groups or batches. The opening, extraction, sequencing and orienting of the invoices and checks has been effected manually, and more recently by the use of automated or semi-automated equipment. Once arranged in stacks, the sequenced and oriented invoices and checks are then separated into groups of documents.

This grouping, referred to as batching, has, in the past, typically been performed manually by inserting batch tickets into the stacks of documents to physically define selected batches of documents. The stacks of batched invoices and checks are then transferred to a separate remittance processing device and fed through the device multiple times to effect the necessary remittance processing.

In some prior art systems, the stacks of invoices and checks are transferred to a separate remittance processing device after the documents have been extracted from the envelopes. In such transfers, errors may arise in determining which documents belong to which distinct transactions. Errors may arise in defining transactional boundaries, because the documents have already been separated from the envelopes that physically and accurately define the boundaries before processing is commenced.

Therefore, the remittance processing apparatus must attempt to determine the transactional boundaries, based on the sequence of the documents that are fed through the device. If the sequence of documents is not predetermined and precisely maintained, the transactional boundaries may be misplaced and transactional integrity lost. For example, if more than one check is enclosed with a single invoice, it becomes difficult, after the extraction has already been performed, to ascertain whether the additional check should be included with the preceding or the following transactional documents. As a result, a check from one transaction may be processed erroneously with an invoice from another transaction.

Other problems may also arise whenever the invoices and the checks are not in proper uniform sequence or in the proper orientation. For example, the lack of proper sequencing and orientation may cause misreads or errors during processing. If a check is being read, instead of an invoice due to an improper sequence, the appropriate information will not appear at the proper location during document imaging.

Current integrated remittance processing systems are available which attempt to maintain transactional integrity. Examples of this general type can be found in U.S. Pat. Nos. 5,054,6.20, 5,810,173, 5,842,577 and 5,842,693. These high speed remittance processing systems are designed to process clean, same-sized remittance mail containing a single check and bill stub, i.e., bulk mail. These prior art systems are capable of high volume throughput, opening large volumes of remittance mailing without causing damage to the contents, but only if the envelopes and remittance documents are the same size.

However, envelopes are generally not the same size. Even in circumstances where customers are provided with standardized return envelopes, customers may frequently choose to respond via odd-sized envelopes. Furthermore, other activities, such as promotions, commercial announcements, coupons, and return correspondence can vary greatly in size and shape, and affect the transactional throughput.

"White mail", also known in the remittance processing and document processing industry as "exception mail", is a challenge unique thereto. This mail is represented by mixed sized envelopes and/or mixed and varying contents, such as, for example, full page, triple folded documents and/or folded checks. The prior art systems fail to accommodate such white mail in an efficient, non-damaging manner.

Specifically, the problem of opening an edge of white mail, without damaging the contents, has not been satisfactorily solved. Typically, such white mail must be manipulated, either by vibrating machines or by hand, to force the contents away from the edge to be cut. Another solution is to use an opener that must be handfed by the operator, again affecting throughput time and efficiency.

Moreover, it should be noted that the above discussed prior art systems generally provide a means for opening the envelope and extracting the white mail contents without otherwise processing the contents. Generally, any attempts to solve these problems have used large multi-station machines or two or more machines, an example of which is set forth in U.S. Pat. No. 4,934,892. Generally, such machines open the envelopes on one or two sides and serially move the envelopes to an extraction station. At the extraction station, vacuum fingers are employed to engage the panels of the envelopes so that the contents may be extracted by the operator.

One major drawback of these machines is their failure to maintain transactional integrity. The contents must be moved to a second machine or station for further processing, which generally employ vacuum arms for extraction. The extraction time on such machines is limited to the cycle time that the vacuum arms engage and pull apart the envelope panels. The operator is limited to the amount of time to extract the contents. Furthermore, the vacuum can bleed through the panels and hold the contents in place, making extraction difficult.

One solution has been to employ opener/extractors that open the envelopes on two or more sides, and move the envelope panels away from the contents without using vacuum arms. One such opener/extractor is disclosed in commonly assigned U.S. Pat. No. 4,893,454 which is incorporated herein by reference. A feature of that opener/extractor is that the system folds the panels away from the contents. However, while the disclosed opener/extractor solves some of the above-discussed problems, it does not provide a stand-alone system for opening, extracting and scanning/processing white mail, while ensuring transactional integrity.

In accordance with the present invention, a system and method are provided for opening the envelopes, extracting the contents therefrom, reordering and reorienting the contents, if necessary, and imaging and storing data regarding the contents so that the association among the contents is maintained. Proper imaging of the contents and storage of the data will ensure transactional integrity during subsequent remittance processing. Moreover, maintaining transactional integrity for each transaction provides a easy method for resolving discrepancies should a mistake occur.

SUMMARY OF THE INVENTION

The present invention provides a new and useful system for processing, i.e., extracting and scanning, the contents of a plurality of envelopes. The system embodying the present invention is especially suitable for processing "white mail". In particular, the system monitors the boundaries of each transaction as the contents are processed. Because each envelope defines the boundaries for each transaction, and the contents are initially contained within envelopes, the boundaries for each transaction are known.

Once the contents are extracted from an envelope, the system ensures that the contents from one transaction do not become associated with the documents from a different transaction. For example, the system ensures that a check from one envelope does not become associated with an invoice or document from a next envelope. Moreover, the system provides sufficient time to ensure that all the contents of the envelope are processed. This is referred to as maintaining transactional integrity.

The system maintains transactional integrity throughout the entire remittance process. The present invention comprises a milling device, an image acquisition device operable communication with the milling device, and a control device, including control logic, operably connected to at least the milling device and the image acquisition device. The present invention is a stand-alone, integrated system that opens the envelopes on at least one, but preferably two or more, sides, thereby exposing the contents thereof for extraction. The system further acquires an image of the contents and stores such image as data in digital form in a database. While the contents of one envelope are presented to the image acquisition device, a next envelope may be opened. After all the contents of the one envelope are processed by the image acquisition device, a new file may be created in the database, all while maintaining transactional integrity. Moreover, maintaining transactional integrity provides easy discrepancy resolution should an error occur.

Numerous other advantages and features of the present invention will become readily apparent from the following detailed description of the invention, from the claims, and the accompanying drawings.

BRIEF DESCRIPTION OF THE DRAWINGS

In the accompanying drawings, that form a part of this specification, and in which like numerals are employed to designate like parts throughout the same.

DETAILED DESCRIPTION OF THE INVENTION

Figure 1:
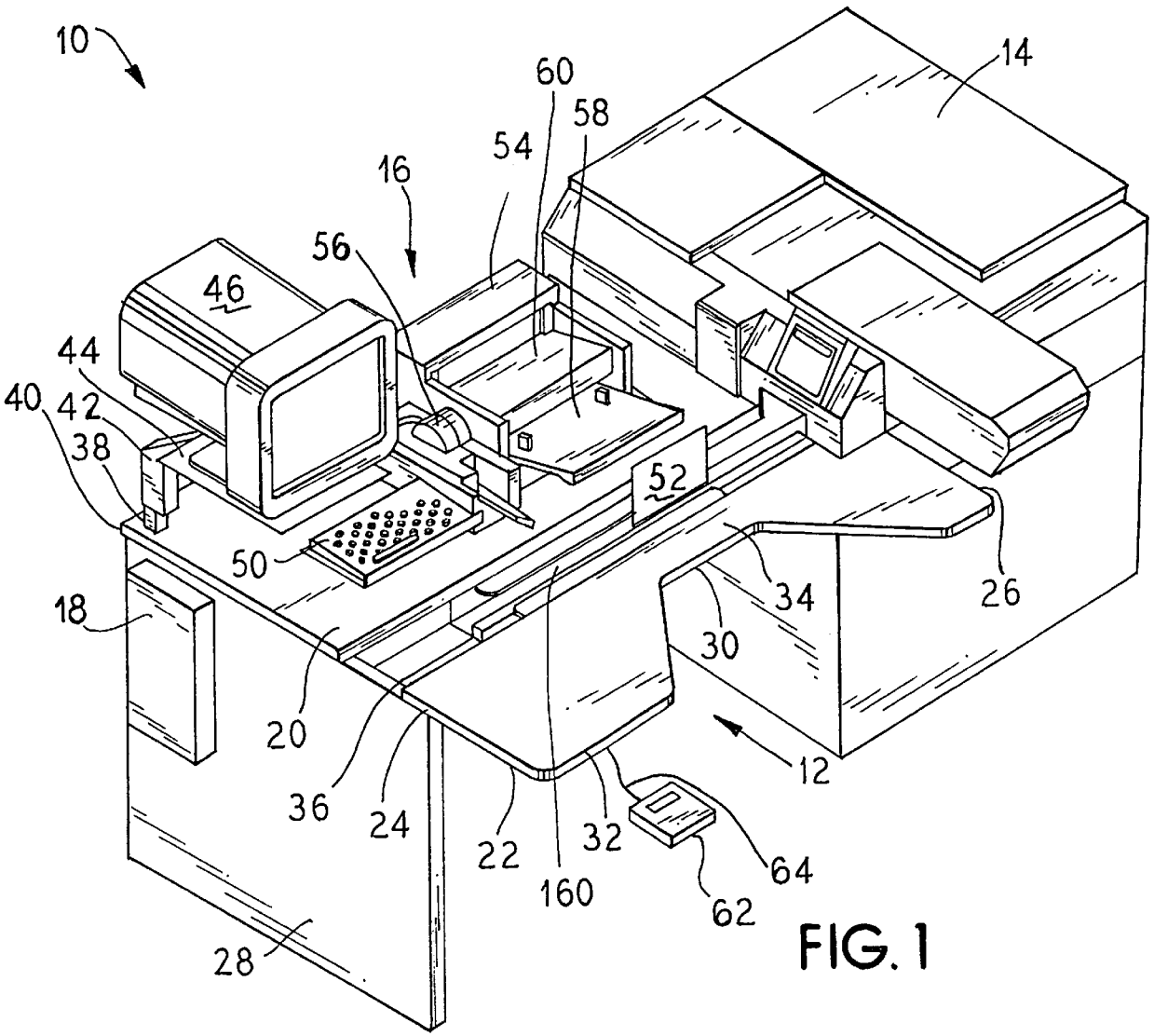
FIG. 1 is a perspective view of one embodiment of the extraction and scanning system in accordance with the present invention.

Referring to FIG. 1, a perspective view of a stand-alone integrated system for processing, including extracting and scanning, the contents of a plurality of envelopes, generally designated 10, in accordance with the present invention is shown. In the embodiment depicted in FIG. 1, system 10 includes a workstation 12, an opening device 14, at least one image acquisition device 16 and a control device 18, including control logic.

Workstation 12 depicted in FIG. 1 includes top and bottom surfaces 20 and 22 respectively, formed with side edges 24 and 26, and includes at least one support member 28, which extends between the bottom surface 22 and the ground. While one support member 28 is depicted, two or more are contemplated. Furthermore, it is contemplated that support member 28 may be fixed to bottom surface 22 by screws, pins, glue or the like. However, it is also contemplated that bottom surface 22 may rest on the support member 28 in an unfixed manner.

Top surface 20 is shown with a first cutout 30 defined in front edge 32, forming at least one work surface 34. Work surface 34 defines at least one workstation, providing an operator with space to prepare documents prior to scanning. A second cutout or track trough 36 is defined below top surface 20 in proximity to the first cutout 20, extending from side edge 24 to side edge 26, where track trough 36 accommodates an associated envelope track, discussed in greater detail below.

Additional cutouts are contemplated. FIG. 1 depicts a third cutout 38 formed in proximity to back edge 40 to accommodate a snorkel support 42 for a computer monitor shelf 44 supporting monitor 46. Additionally, a fourth cutout 48 (not shown) is contemplated to accommodate the at least one image acquisition device 16 or an alphanumeric keyboard 50.

The above-described layout provides an ergonomic environment for the operator and provides easy access to the work components of system 10, however other layouts are contemplated. Workstation 12 could be formed as two separate units, i.e. front and back units, each independently fixed to support member 28. Furthermore, instead of using cutouts 38,48, off-the shelf items such an monitor supports and keyboard stands can be purchased to support the monitor 46, keyboard 50 and/or image acquisition device 16, and affixed to the workstation 12.

In addition, it is contemplated that a storage cabinet 49 (best seen in FIG. 3) could be positioned proximate to the workstation 12 and/or an empty envelope receptacle 51 (best seen in FIG. 3) could be disposed beneath the workstation 12. The envelopes, following extraction of their contents, move from the right to the left in the envelope track and fall through an opening formed at the end of track trough 36 into the empty envelope receptacle.

Figure 2:
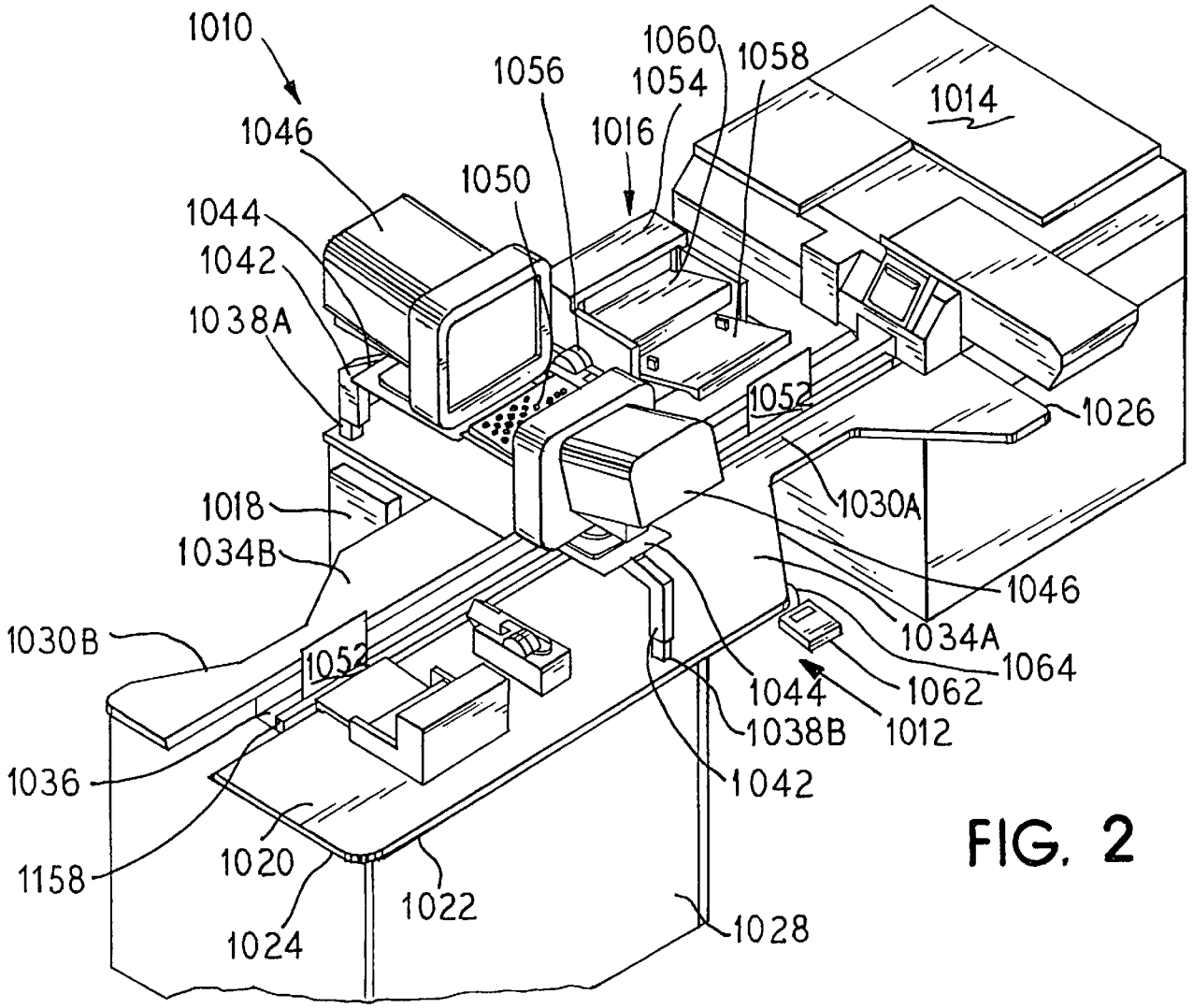
FIG. 2 is a perspective view of a second embodiment of the extraction and scanning system in accordance with the present invention.

Referring now to FIG. 2, a perspective view of a second embodiment of the system for processing, including extracting and scanning, the contents of a plurality of envelopes, generally designated 1010, in accordance with the present invention is shown. Correspondingly, where appropriate, the last two digits in the 1000 series of numbers depicted in FIG. 2 are connected to elements having the same function and/or structure as those depicted in FIG. 1. In the embodiment depicted in FIG. 2, system 1010 includes a workstation 1012, an opening device 1014, at least two image acquisition devices 1016 and a control device 1018, including control logic.

Like workstation 12 of FIG. 1, workstation 1012 depicted in FIG. 2 includes top and bottom surfaces 1020 and 1022 respectively, formed with side edges 1024 and 1026, and includes at least one support member 1028, which extends between the bottom surface 1022 and the ground.

The system 1010 of FIG. 2, differs from system 10 of FIG. 1, in that at least two workstations are defined. Top surface 1020 is shown with the first cutouts 1030A and 1030B defining two workstations, providing the operators with work surfaces 1034A and 1034B respectively. Work surfaces 1034A, 1034B provide the operators with space to prepare the documents prior to scanning. A second cutout or track trough 1036 is defined below top surface 1020 between first cutouts 1030A, 1030B, extending from side edge 1024 to side edge 1026, where track trough 1036 accommodates an associated envelope track, discussed in greater detail below.

Additional cutouts are contemplated. FIG. 2 depicts cutouts 1038A and 1038B accommodating the snorkel supports 1042 for the computer monitor shelf 1044, supporting monitors 1046. Additionally, cutout 1048 is contemplated to accommodate the at least two image acquisition devices 1016 or an alphanumeric keyboards 1050.

In the embodiment depicted in FIG. 2, it is contemplated that two operators would work at the two defined workstations. The contents 1052 of a first envelope would be processed by a first operator, while the second envelope would serially pass to the second operator for processing.

Attention may now be paid to the control device 18, including control logic, operably connected to at least the opening device 14 and the image acquisition device 16, preferably by electrical connectors (not shown). While only control device 18 is referred to herein, the description is equally applicable to the control device 1018. Control device 18 could take many forms, but in one embodiment, it is comprised of at least one microprocessor (MP1) with the control logic, preferably software, operable thereon, which in turn operates and controls the system 10. It is further contemplated that the at least one microprocessor include at least one nonvolatile storage medium operational thereon, for operating and storing a database, which in turn stores the acquired images of a contents 52 of the envelopes as data for later remittance processing.

Additionally, other embodiments are contemplated, such that control device 18 consists of two distinct microprocessors control devices (MP1 and MP2, not shown) including the control logic. In this embodiment, microprocessor control device MP1 is operably connected to at least the opening device 14 and microprocessor control device MP2 is operably connected to at least the image acquisition device 16.

Yet another embodiment contemplates a plurality of microprocessor control devices (MP1 through MPn) containing the control logic operably thereon which in turn are operably connected to at least one other microprocessor or a mainframe computer with the database operable and stored thereon. It is also contemplated that control device 18 is a mainframe computer in operable communication with at least the image acquisition device 16 and the opening device 14, having the control logic and the database operable thereon.

As provided above, the control device 18 is operably connected to at least the image acquisition device 16 and the opening device 14, preferably by electrical connections (not shown) and has the control logic operable thereon, which in one preferred embodiment is customized software. The contents 52 are extracted by the operator and prepared for image acquisition by unfolding, ordering, orientating, and the like. The prepared contents 52 are then presented to the image acquisition device 16, whereby, when an image of the contents 52 are acquired from one envelope as discussed below, a next envelope is opened by opening device 14 and a new file is created in the database.

As also demonstrated above, the control device 18 comprises microprocessor control devices MP1 and MP2, where MP2 is operably connected to at least the image acquisition device 16 and MP1 is operably connected to at least the opening device 14, preferably by electrical connections (not shown). Each microprocessor control device has control logic associated therewith and operable thereon, which in one preferred embodiment is customized software.

The contents 52 of an envelope are extracted by the operator and prepared for image acquisition by unfolding, ordering, orientating, and the like. Removing the contents 52 from an envelope sends a signal to MP1 to instruct the opening device 14 to open a next envelope. The prepared contents 52 are then presented to the image acquisition device 16, whereby, when an image of the contents 52 are acquired from one envelope as discussed below, the file containing the image of those contents 52 is closed in response to a signal generated by the microprocessor control device MP2 of control device 18. A new file may now be created in the database for the contents of a next envelope.

FIGS. 1 and 2 depict image acquisition device 16, 1016 as two separate devices, however one device is contemplated, as discussed below. In the depicted embodiments, the image acquisition device 16, 1016 comprises an optical scanner 54, 1054 and a check/remit scanner 56, 1056. Again, while only optical scanner 54 and check/remit scanner 56 of image acquisition device 16 are discussed, the description is equally applicable to optical scanner 1054 and check/remit scanner 1056.

It is additionally contemplated that image acquisition device 16 could comprise only one scanner. In this embodiment, system 10 would include only one scanner, optical scanner 54 for example, for scanning contents 52. Optical scanner 54 could scan all the contents 52, including the checks and remit documents, or it could be used to scan only the documents, including the full page documents. If checks or remit documents are to be processed in this embodiment, they could be processed in a second workstation.

Accessing control device 18, the operator can select a number of modes displayed on monitor 46 for operating the image acquisition device 16. The operator can select either the check scanning mode, document scanning mode or both, using the keyboard 50, a trackball or mouse (not shown). As provided above, when an image of the contents 52 of one envelope is acquired by the image acquisition device 16, a file is opened in the database and the data representative of the image contents of the first envelope (digital image) are stored in the database for later remittance and/or document processing.

At approximately the same time, taking into account system lag time, the control device 18 sends a signal to the opening device 14, instructing it to open a next envelope, wherein the contents 52 thereof may be prepared for image acquisition. When the acquisition of the contents 52 of the first envelope are complete, the prepared contents 52 of the next envelope are presented to the image acquisition device 16. The control device 18 generates a signal such that the file generated for the contents 52 of the first envelope is closed, and a file for the contents 52 of the next envelope is opened. At approximately the same time, the control device 18 generates another signal to the opening device 14 instructing it to open a next envelope, all the while maintaining transactional integrity.

In yet another contemplated system 10, removing the contents 52 from the envelope triggers a detector device. The detector device sends a signal to the microprocessor control device MP1 of control device 18, which in turn sends a signal to the opening device 14. Opening device 14 is instructed to open a next envelope, wherein the contents 52 thereof may be prepared for image acquisition.

When the acquisition of the contents 52 of the first envelope are complete, the file is closed using an operational control device in operable communication with the microprocessor control device MP2 of control device 18. Microprocessor control device MP2 of control device 18 generates a signal such that the file generated for the contents 52 of the first envelope is closed. The prepared contents 52 of the next envelope can then be presented to the image acquisition device 16, and a file for the contents 52 of that next envelope is opened, all the while maintaining transactional integrity.

The above cycle is repeated until all the envelopes are opened, and an image of contents 52 of all the envelopes are acquired. In one preferred embodiment, only the contents of one envelope are scanned at a time. In this embodiment, all the contents 52 of one envelope are scanned before the contents 52 of the next envelope are scanned, i.e., while the contents 52 of the next envelope are being prepared, maintaining transactional integrity.

As provided above, control device 18 has at least one microprocessor, however, it may be desirable to include a plurality of microprocessors for parallel processing of the data obtained in the image acquisition. In one embodiment, an imaging computer (not shown) controls the acquisition of the contents 52 and storage of the data, and communicates that data to the control device 18. The imaging computer would include an interface card to provide an interface between the control device 18 and the imaging computer. The control device 18 could be connected to the interface card of the imaging computer via a high speed serial channel. The imaging computer may include an image acquisition card or frame grabber providing an interface between the imaging computer and the image acquisition device 16.

It is also contemplated that control device 18 act as the imaging computer. In this case, the interface card and the serial channel would be unnecessary.

It is contemplated that the white mail to be processed may contain remit documents, payment stubs or invoices, checks, separate documents (referred to generally as other documents or full page documents), or some combination thereof. Generally, the full page documents are approximately 8½" by 11" in size and folded, and are optically acquired by the optical scanner 54 which preferably includes at least one high resolution optical page scanner.

In the embodiment depicted, an optical scanner 54 incudes an input device or a feed tray 58 having rollers (not shown), and output device or an out tray 60. Prepared contents 52 are inserted into the feed tray 58 by the operator so that contents 52 engage the rollers. The rollers forming nips engage the contents 52 so that they are passed into the optical scanner 54, in a manner well known in the art, scanned, and passed out to the out tray 60 for collection by the operator.

While rollers forming a nip are preferred for receiving the contents 52, other means, such as image entry sensors, are contemplated. The image entry sensors are operably connected to at least the control device 18, so that when an image of the contents 52 of one envelope is acquired, a next envelope is opened and a new file created. It is contemplated that feed tray 58 could include a photocell and associated light source just in advance of the roller and operably connected to the control device 18. When the photocell senses the presence of the contents 52, the next envelope is opened and a new file is created.

As provided above, control device 18 could include microprocessor control device MP2 operably connected to at least the image acquisition device 16. When all the contents 52 of have been acquired, microprocessor control device MP2, preferably in response to a signal generated by an operational control device, generates a signal closing the file containing the images thereof, all the while maintaining transactional integrity.

Alternatively, the envelope track could include at least a pair of pressure rollers, or any other device suitable to monitor envelope thickness or the change in presence of contents. When the pressure rollers detect a change, i.e., that contents 52 have been removed from the envelope, then control device 18 issues commands to open the next envelope. In one embodiment, microprocessor control device MP1 issues such command.

The envelope track could include a plurality of photocells and associated light sources, or any other monitoring device, acting as a candling device in operable communication with microprocessor control device MP1. When the photocells detect a change in the envelope, microprocessor control device MP1 instructs that the next envelope be opened.

At least one photocell and associated light source (not shown) could be positioned on the envelope track in line with contents 52 which are exposed for extraction, so that the contents 52 interrupt the beam generated by the light source. After the operator removes the contents 52 from the envelope, the beam is reestablished. This generates a signal which is transmitted to the microprocessor control device MP1, which instructs the opening device 14 to open a next envelope.

As provided above, it is preferred that the optical scanner 54 include at least one high resolution optical page scanner. In one contemplated embodiment, the optical scanner 54 includes at least one high resolution line scan camera. The camera is directed toward a plate that is located along the document path. The plate has an aperture so that the documents conveyed past the plate are revealed to the camera. The roller having a resilient outer surface, such as foam rubber, confronts the plate forming a nip for receiving the documents being transported through the optical scanner 54. Because the outer surface of the roller is resilient, the roller urges the documents flush against the plate to ensure that the documents are a fixed distance from the camera, for proper focusing, as the documents pass the aperture in the plate. Lights straddle the aperture in the plate illuminate the surface of the documents as the documents pass by the aperture.

The imaging camera is mounted in position on the base plate to scan the image of the front face of each document conveyed along the document path. Additionally, the optical scanner may include a second camera similar to the first camera, but mounted in position on the base plate to scan the image of the back face of each document conveyed along the document path. If a second camera is included, a second plate, a second resilient roller and a second lights similar to the plate, roller and lights accompanying the first camera, are also included. Additionally, the second camera, interfaces with and is controlled by the control device 18 or imaging computer in the same manner as the first camera. In this way, the second camera allows the apparatus to capture images such as customer responses that appear on the back of an invoice.

One example of the imaging cameras are high resolution line scan cameras suitable to achieve the required dpi image resolution. The transport moves at approximately 150 inches per second, and the acquisition rate of each camera is matched to the transport speed so that the required dpi image resolution is achieved. The imaging cameras scan the documents and acquire data representing the light intensity at discrete points of each document. For each point, or pixel, the light intensity is represented by a gray scale number ranging from zero for black to 255 for white. The light intensity for each pixel is communicated to the control device 18 or image acquisition computer as an eight bit representation corresponding to the gray scale number.

In one preferred embodiment, in response to signals received from the control device 18 or the image acquisition computer, the operation of the image acquisition is controlled via a frame grabber. When the rollers or image entry sensor detects the presence of a document, a signal is sent to the control device 18 indicating the presence of a document. The control device 18 or image acquisition computer then sends a signal to the frame grabber indicating whether the document detected by the optical scanner 54 is to be scanned. At the same time, the control device 18 may send data to the image acquisition computer regarding the document. For instance, the control device 18 sends a signal to the image acquisition computer indicating what the batch number is for the document and whether the document to be scanned is a check or an invoice (remit).

If the control device 18 or image acquisition computer indicates to the frame grabber that a document is to be imaged, the frame grabber sends control signals to the imaging cameras, such that the cameras scan the document to acquire image data. The frame grabber receives the image data from the cameras and then stores the data in a database and memory residing on the frame grabber card. The image acquisition computer or control device 18 then transfers the image data from the frame grabber memory into the non-volatile imaging memory.

Alternatively, the image data can be transferred directly to the RAM of the image acquisition computer or control device 18 without storing the data in the memory resident on the frame grabber card.

Once the image data is transferred to the RAM of the image acquisition computer, the image data is processed by the control device 18 microprocessor, which may include separate processors MP1 through MPn. First, the gray scale data is binarized to create a black and white representation of the document image. By binarizing the data, the data for each pixel is converted from an eight bit gray scale representation, to a one bit black or white representation, which significantly reduces the space that is required to store the image data. In addition, binarizing the image data operates to highlight the textual portions of the image, which is advantageous for further processing of the image data.

As provided above, the image acquisition device 16 may include a check/remit scanner 56 alone or in some combination with a optical scanner 54, which preferably is a MICR character reader. The preferred MICR character reader includes a magnet (not shown) for magnetizing the magnetic ink markings on the checks and remit documents and a magnetic character read head (not shown) for reading the characters of the magnetized markings. To scan the MICR line, the documents are first conveyed past the magnet which imparts a magnetic charge to the magnetic ink on the checks and/or remit documents. The documents are then conveyed past the magnetic character read head which detects the variations in magnetic flux. After reading the variations in magnetic flux, the MICR character reader determines the characters that make up the MICR line of each magnetized check. The MICR module then communicates the data representing the MICR line to the image acquisition computer or the control device 18.

Check/remit scanner 56 attempts to read the OCR line if the document is an invoice (remit document) or the MICR line from MICR character reader if the document is a check. The OCR line data is necessary for later remittance processing, because the OCR line for an invoice includes information about the customer's account and the amount of the invoice. During remittance processing, the customer account number must be known so that any payments can be posted to the correct account to ensure transactional integrity. In addition, during remittance processing, the invoice amount needs to be known to determine if the correct amount of a check has been entered. To determine a check amount during remittance processing, the amount of a check is either manually or automatically entered into system 10 using keyboard 50 and then compared with the invoice amount. If the check amount matches the invoice amount, it is assumed that the check amount was properly read. If the two amounts do not match, then the check amount is rekeyed.

Therefore, the OCR line data which includes the invoice amount and account number is needed for further remittance processing. Based on data received from the control device 18, preferably based on the mode of operation, the imaging acquisition computer or control device 18 knows whether a document is a check or an invoice. If the document is an invoice, the imaging computer or control device 18 processes the image data for the document in order to determine the document's OCR line, which typically appears at the bottom. The OCR line is a series of characters printed in a uniform predefined typeface of predefined size. Commonly, the typeface is a type referred to as OCR A, however, typeface OCR B, E13B and others can also be read.

The image acquisition computer or control device 18 and optical scanner 54 can function to process the checks and remit documents, so that these documents are read optically by the scanner 54 rather than magnetically by the check/remitt scanner. In this embodiment, while it is possible to enter the check amount manually using keyboard 50, it may be desirable to use the image acquisition computer and optical scanner 54 to enter and/or verify the check amount. Here, the check is fed into the optical scanner 54 rather than the check/remit scanner 56. The optical scanner 54 acquires an image of the check, similar to the documents above, and the amount is entered into the database for later processing.

Alternatively, the imaging computer and optical scanner 54 can function to process the image data to read the MICR line of checks so that the MICR line is read either optically by the scanner 54 and magnetically by the check/remit scanner 56. As previously described, the check/remit scanner 56 magnetically reads the MICR line on the checks. However, the MICR character reader may be unable to read one or more characters in a MICR line because of imperfections in the magnetic characteristics of the MICR line ink.

These magnetic imperfections, however, may not affect the optical scanner's 54 ability to read the MICR line from the optical image data, so that a character that cannot be read magnetically may be readable optically. Therefore, if the MICR character reader is unable to read a character in a MICR line, the data obtained optically is used to supplement the data obtained from the MICR character reader in an attempt to complete the MICR line data.

By verifying the results as described above, the possibility of checks being processed with improper MICR data is reduced. For this purpose, the MICR line data obtained optically can be compared with the MICR line data from the MICR character reader. Any mismatch between the optically read MICR line and the results from the check/remit scanner 56 indicates that the MICR line was not determined. The control device 18 can then tag the document as having an undetermined MICR line and that document, along with the remaining contents in the same transaction, can be directed to a reject bin or rescanned accordingly, all the while maintaining transactional integrity. Furthermore, the verification process described above provides easy access to any transaction to correct deficiencies.

After the OCR line or MICR line data for a document is extracted from the image data, the image data for the document is processed. Processing the data can include compressing the image data, which is combined with the data representing either the MICR line or the OCR line, along with data from the control device 18 to form a data record for the document. The data from the control device 18 includes information from the envelope from which the particular document was extracted, such as a change of address indication, the presence of a postnet barcode, and the presence of a mark indicating a customer response. The data from the control device 18 also includes an indication of whether the MICR line and OCR line was completely determined during imaging.

Accordingly, the data record for a document includes all relevant customer transaction data including, but not limited, to the image data, the MICR or OCR line, an indication of whether the OCR or MICR line is complete, and miscellaneous information obtained during the processing of the contents 52, such as customer response data in the form of a change of address, or a check mark in a response mark. Providing such a complete data record provides for easy access to any transaction to correct deficiencies or mistakes.

During remittance processing, it is contemplated that mistakes may be made and images may need to be rescanned to maintain transactional integrity. To correct such mistakes, the system 10 contemplates an operational control device operable connected to at least the control device 18, so that a miscanned image may be corrected.

In the embodiment depicted in FIGS. 1 and 2, the operational control device discussed above comprises a foot pedal 62 (1062 in FIG. 2) operably connected to at least the control device 18, preferably electrically connected to at least the microprocessor by connector 64 (connector 1064 in FIG. 2). The footpedal 62 is used by the operator to corrected miscanned images as viewed on the monitor 46.

As provided above, the contents 52, either the documents, checks or remit documents, are prepared for scanning and feed to image acquisition device 16. After the file is opened in the database and the image is acquired, the image is displayed on the monitor 46. If the operator determines that the contents 52 have been miscanned or some other mistake made, the operator can correct the miscan or other error by depressing foot pedal 62.

In one preferred embodiment, when foot pedal 62 is depressed, the acquired image in the database is deleted. The contents 52 may again be prepared and presented to the image acquisition device 16 for scanning. Again, the acquired image is displayed on the monitor 46. If correct, the next contents are presented to the image acquisition device 16 and a new file is created.

However, in one embodiment where control device 18 consists of microprocessor control devices MP1 and MP2, foot pedal 62 (or any of the other means discussed below) operates as an operation control device to send a signal to close the files. Foot pedal 62 is operably connected to microprocessor control device MP2, preferably by electrical connector 62. After all of the contents 52 of one envelope have been acquired, the operator can activate foot pedal 62, which transmits a signal to the microprocessor control device MP2, which in turn generates a signal so that the file in the database is closed.

While the footpedal 62 is contemplated as the preferred operational control device, a number of means could be employed to correct miscans and mistakes, including keyboard 50, a mouse or rollerball. Additionally, other devices, including monitor 46, or a separate monitor, having a touch screen or a light pen could be employed, whereby operational commands may be entered directly on the monitor screen. It is further contemplated that a operational commands could be entered using voice commands by a microphone in operational communication with the control device 18.

It is contemplated that system 10 could assign the images into single, distinct transactions which may be grouped into batches stored in the database. Control device 18 assigns all the contents 52 extracted from one envelope into a single distinct transaction and can be maintained on the system 10 in that way. Alternatively, control device 18 assigns the contents 52 extracted from one envelope into the single distinct transactions which are then grouped into batches, referred to generally as the batch mode.

In the batch mode, the documents are sorted and maintained in groups referred to as batches, which are identified by a unique batch number. The image data for a batch of documents is organized and maintained into batch data record files. The batch files are organized so that the organization of the images in a particular batch file directly corresponds to the organization of the documents in the batch, thus maintaining transactional integrity.

A complete batch file includes a batch header and the data records for each of the documents in the corresponding batch. The batch header includes information that is common to all of the documents in the batch, such as the batch number, the date the documents were processed, and the number of documents in the batch. Once all of the records have been appended to a batch file, the batch file is exported from the computer to the control device 18 or a separate mainframe for subsequent processing.

In one embodiment, the batches of documents are separated by various control documents, such as a batch header ticket that may be placed at the beginning of each batch, for example for the contents 52 of 100 envelopes, a batch trailer ticket that may be placed at the end of each batch, and a control ticket that may be placed behind the batch header ticket. Preferably, the batch tickets have a different shape, generally taller, than most of the documents in the batches. Consequently, when several batches of documents are stacked together, the batch tickets separating the individuals batches are readily identifiable. The batch number is printed in magnetic ink on the face of each batch ticket in the same location as the MICR line on checks and hence can be read by the check/remit scanner 56.

In the batch ticket mode, the batch tickets and/or other control documents are inserted at the beginning of each stack of documents. In one mode batch header tickets are fed for each batch of documents, and may include one batch header ticket for the documents in a batch, one batch header ticket for the remit documents in a batch and one batch header ticket for the checks in the batch. The batch header tickets are loaded so that the batch ticket number is in a predetermined orientation to permit proper imaging as will be discussed below.

In addition to the basic mode of operation, it may be desirable to have a batch trailer ticket placed at the end of each batch of documents, either for the whole batch or one batch trainer ticket for each document, check and remit document. In this way, each batch of documents, each batch of checks and each batch of remit documents has a batch header ticket at the front of the batch and a batch trailer ticket at the end of the batch.

In yet another variation, it may be desirable to place a control ticket into each batch of documents, remit documents and checks. Typically, the control ticket is placed behind each batch header ticket.

The batch tickets are then conveyed past the check/remit scanner 56 which determines the characters that make up the batch ticket number. The scanner 56 then communicates the batch ticket number to the image acquisition computer (or control device 18) which communicates the batch ticket number to the control device 18. Control device 18 then uses the batch number to monitor and control the processing of the corresponding batch of documents. For example, if the check/remit scanner 56 reads a batch ticket MICR line and determines that the batch ticket number is 5; the information is then communicated to the image acquisition computer and in turn to the control device 18. Control device 18 then assigns checks and remit documents into batch 5. When a document enters the image acquisition device, control device 18 informs the imaging computer that the document should be imaged and assigned to batch 5. As this example illustrates, the batch ticket MICR data is communicated back and forth between the image acquisition and/or control device 18 computer after the check/remit scanner 56 images the batch ticket. From the check/remit scanner 56 the batch tickets are inserted into the optical scanner 56 and image data is acquired for the batch tickets.

Attention may now be turned to the opening device 14, 1014 of FIGS. 1 and 2 for opening the envelopes on at least one edge, forming opened envelopes, and exposing the contents thereof for extraction. Many embodiments are contemplated for opening device 14 including a slitting device (not shown) well known in the art, that slits the envelopes on at least one edge forming opened envelopes; or an edge severing device, again well known in the art, that severs a portion of the envelopes on at least one edge forming said opened envelopes.

However, in one preferred embodiment, opening device 14 comprises a milling device 66, that mills a portion of the envelopes, between about 0.010 inches to about 0.015 inches, on at least one edge, but generally two or more edges (on at least a leading edge and a longitudinal edge) forming opened envelopes.

Figure 3:
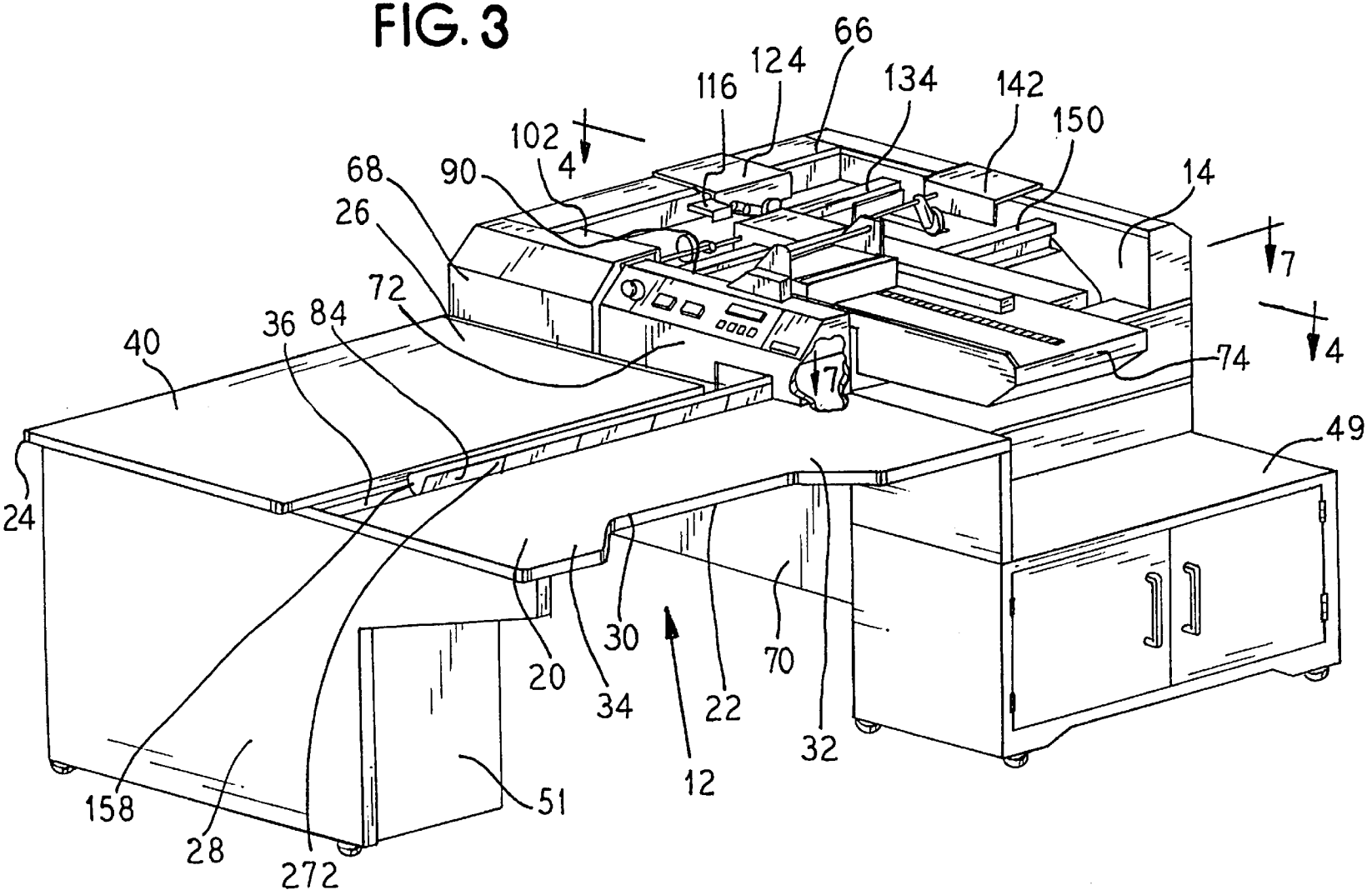
FIG. 3 is a perspective view of the opening device and the workstation of FIG. 1 in accordance with the present invention with the image acquisition and control devices removed.

Turning now to FIG. 3, a perspective view of the milling device 66 and the workstation 12 of FIG. 1 is shown with the image acquisition and control devices 16, 18 among other items, removed. The milling device 66 has a housing 68 and is shown with at least one chip receptacle 70. The chip receptacle 70 is large enough to be positioned under three different cutters, as to be explained hereinafter, to receive the chips or chads cut from the edges of the envelopes as they pass between the cutters and fall through an open chute leading directly into chip receptacle 70.

Housing 68 houses the various opening apparatus such as a control panel 72, feed tray 74, the various envelope milling stations and associated gates to be described hereinafter, the envelope transport device, preferably in operable communication with at least the image acquisition device 16 and the opening device 14.

Figure 4:
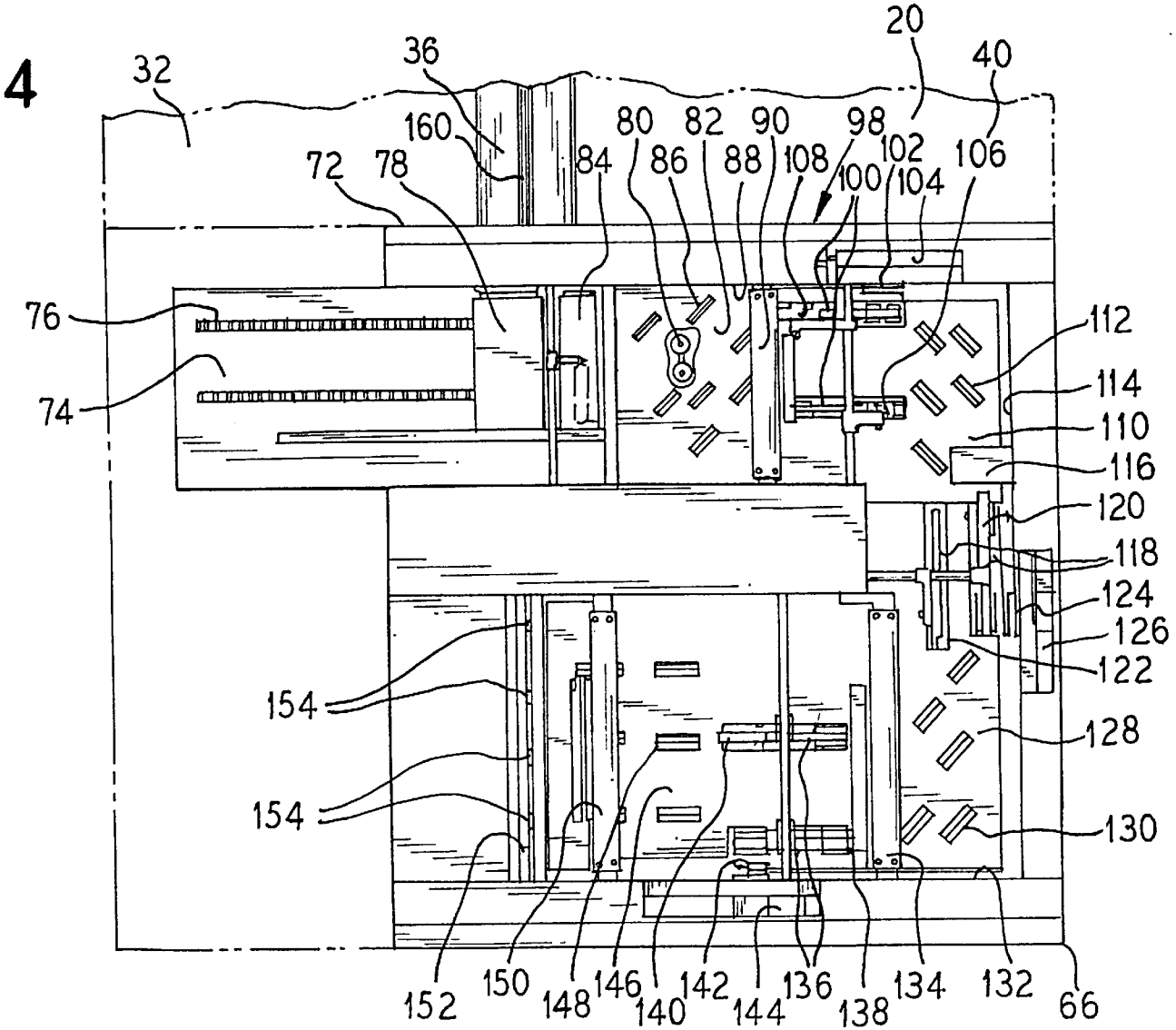
FIG. 4 is a top view of the envelope supply hopper of the opening device of FIG. 3 in accordance with the present invention.
Figure 5:
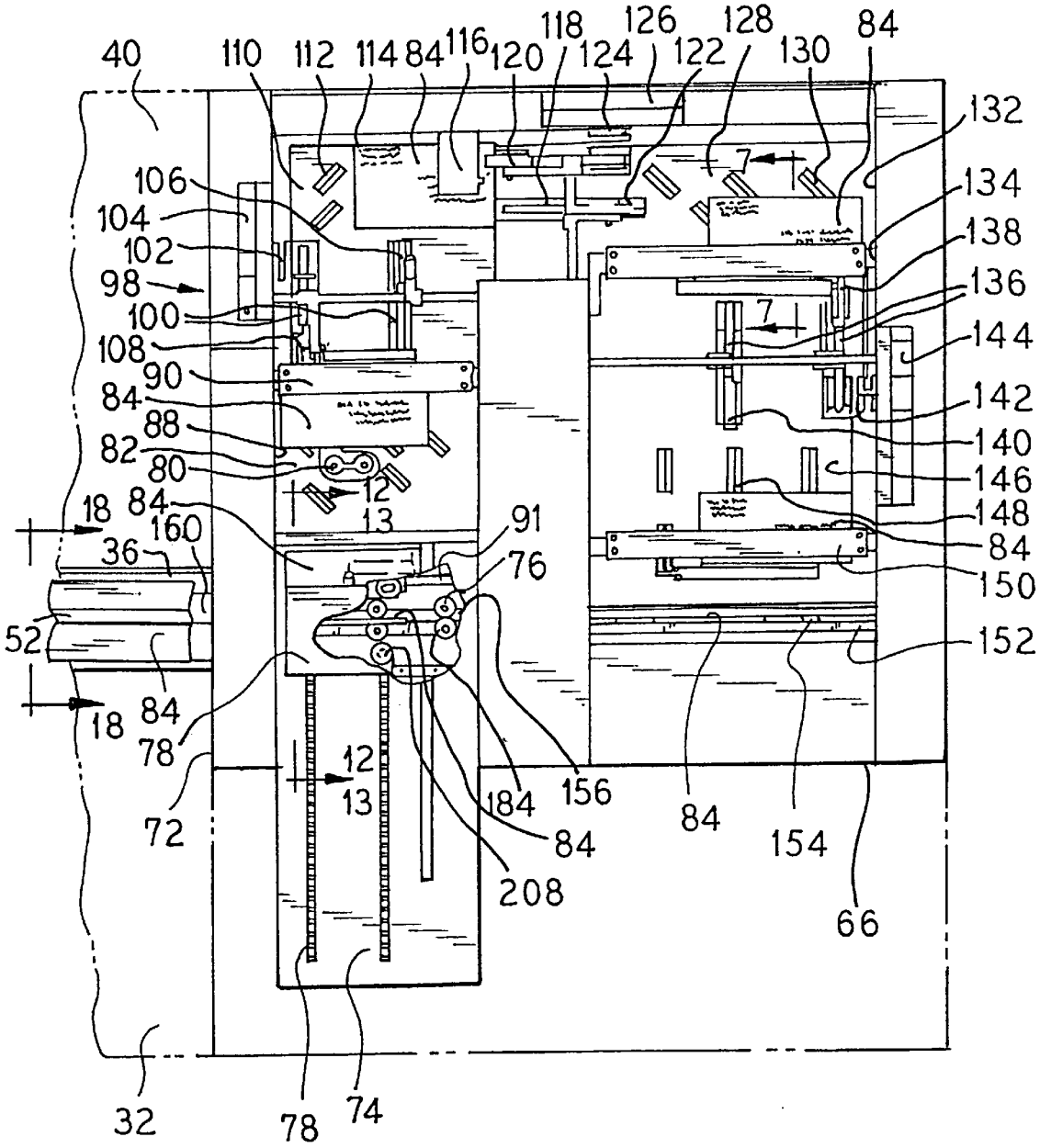
FIG. 5 is an identical top view of FIG. 4 showing an envelope in position at the envelope retaining gates prior to envelope edge milling.

Referring now to FIGS. 4 and 5, there is illustrated a top plan view of the upper portion of the milling device 66. The feed tray 74 includes a set of conveyor chains 76 and associated follower block 78. This setup works in a fashion such that, as envelopes are placed in front of the follower block 78, the conveyor chains 76 will operate until the stack of envelopes reaches a photocell. When the envelopes 84 reach the photocell further actuation of the conveyor chain 76 is stopped until sufficient envelopes 84 have been removed to again actuate the conveyor chain 76 to continuously be moving envelopes 84 into position for extraction from the tray.

Extraction of the envelopes 84 from the feed tray is accomplished by means of a vacuum pickup 80. The vacuum pickup 80 rises up from beneath a wheelplate 82 to engage an envelope 84, and pull it downwardly upon the wheelplate 82. Wheelplate 82 includes a plurality of wheels 86 which are rotating and are positioned on an angle. The envelope 84 engages the wheels 82 and is pulled into alignment against the side rail 88 of the machine and against a first gate mechanism 90. Such an arrangement is illustrated in FIG. 5 wherein the positioning of the envelopes 84 at the respective gates is illustrated.

Figure 10:
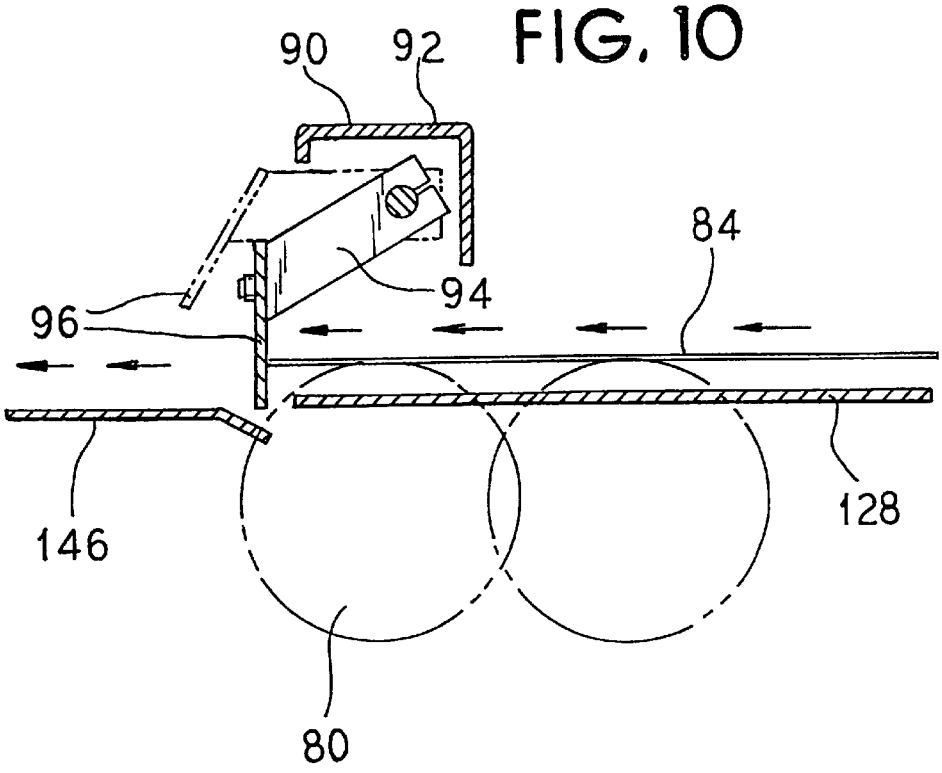
FIG. 10 is a cross-sectional view of a typical envelope retaining gate of the present invention.

A typical envelope gate assembly 90 is illustrated in FIG. 10. Gate assembly 90 includes a cover plate 92 which is secured to the wheelplate 82. Pivoted within the ends of the gate cover 92 is a gate arm 94 and its associated gate 96. FIG. 10 illustrates an envelope 84 riding upon the wheels 96 in abutment with the gate 96 during one phase of the envelope opening cycle.

Returning now to FIG. 4, downstream of the first wheelplate 82 is a conveyor belt assembly 98 including two conveyor belts 100. These conveyor belts 100 are inclined at approximately a 3° angle toward the rail 88 and direct the envelope 84 into a first milling assembly 102.

Figure 6:
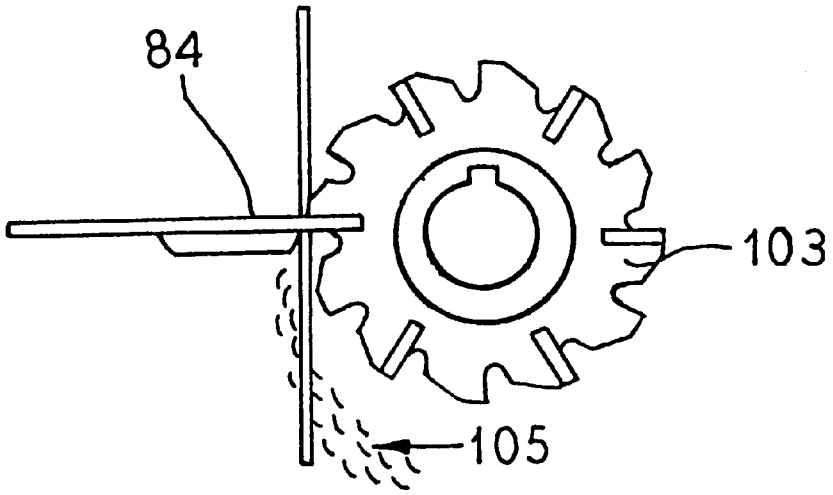
FIG. 6 is an enlarged view partially in section of one embodiment of a mill cutting blade and envelope in accordance with the present invention.

The first milling assembly 102 includes two rotating milling wheels 101 (best seen in FIG. 6). One of these milling wheels 101 is driven whereas the other is in overlapping relationship and is spring loaded. In operation, as the edge of the envelope 84 passes between the milling wheels 101, a small portion thereof is milled or trimmed off, preferably between about 0.010 inches to about 0.015 inches.

FIG. 6 provides an enlarged view partially in section on one embodiment of the milling wheel 101. In this depicted embodiment, envelope 84 is aligned with reference surface 103, so that only a predetermined portion of an edge thereon, preferably between about 0.010 inches to about 0.015 inches, is present to the milling wheel 101. That predetermined portion is then milled, forming chips or chads 105.

As illustrated in FIGS. 4 and 6, the trimmed edge, chip or chad 105, as it is known, of the envelope 84 is free to fall into an open chute 104 which leads downwardly into the chip box or receptacle 70 as illustrated in FIG. 3. This open chute arrangement constitutes an advance in the art inasmuch as heretofore the chips and would often clog or jam causing a shutdown of the machine.

A pair of pressure rollers 106 and 108 are positioned over the conveyor belts 100. The pressure rollers 106, 108 press downwardly on the envelope 84 as it passes along the conveyor belts 100 to insure accurate and positive conveyance of the envelope 84 through the milling assembly 102.

As the envelopes 84 pass through the first milling assembly 102, they come upon a second wheelplate 110. The envelopes 84 first encounter a second set of rollers or wheels 112 which convey the envelopes 84, in a like manner, against a second rail 114 and against a second gate assembly 116. The second gate assembly 116 is substantially of the same design as the first gate assembly 90.

The first wheelplate 82, associated rollers, gate assembly 90 and first milling assembly 102 are designed to trim one small side (or leading edge) of the envelope 84.

Positioned downstream from the second gate assembly 116 is a like set of conveyor belts 118 positioned on a 3° angle. Positioned above them is a like set of pressure rollers 120 and 122. A second miller assembly 124 is positioned at the ends of the conveyor belts 118 and cooperates with a chip chute 126 all in the same manner as that previously described for the first milling assembly 102. The second wheelplate 110 and its associated rollers, gate assembly 116 and associated conveyor belts 118 and miller are designed to open the long edge (or longitudinal edge) of the envelope 84.

Positioned downstream from the second wheelplate 110 is a third wheelplate 128. The third wheelplate 128, as in the case of the other wheelplates, includes a set of inclined roller wheels 130 which are designed to bring the envelope 84 into engagement with the third rail 132 and against a third gate assembly 134, all as heretobefore described.

Positioned again downstream from the third gate assembly 134 is again a set of conveyor belts 136 and associated pressure rollers 138 and 140. These elements cooperate with a third milling assembly 142 and chip chute 144 as heretofore described. This arrangement is designed to open the opposite short side (trailing edge) of the envelope 84 constituting the opening of the third side.

Downstream from the third cutting assembly 134 is likewise a fourth wheelplate 146, associated conveyor wheels 148 which, in this case, direct the envelopes 84 in a straightforward direction to a fourth envelope gate 150.

Downstream from the fourth gate 150 is a V-shaped vertical drop chute 152. Positioned beneath the vertical drop chute 152, and as best seen in FIGS. 7 and 8 of the drawings, are a plurality of drop rollers 154 which form a part of the overall envelope transport system to be hereinafter described.

Figure 7:
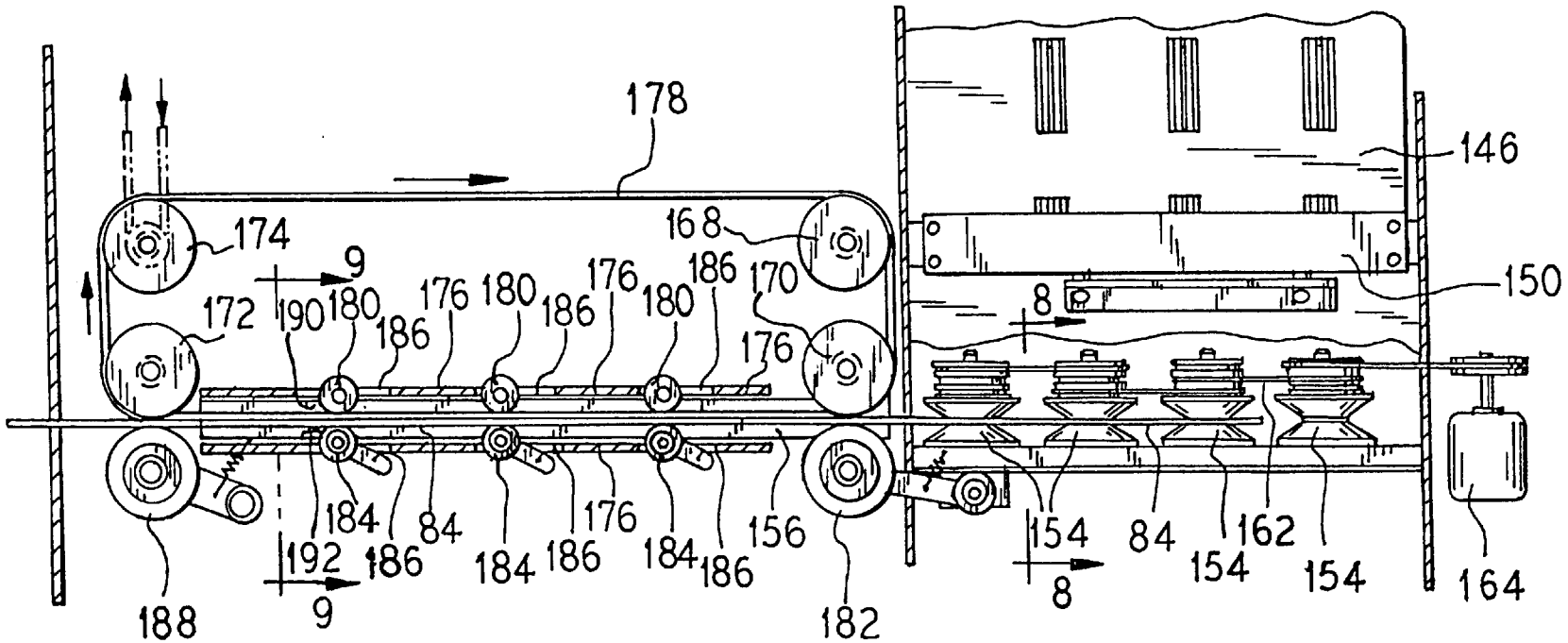
FIG. 7 is a top view of the envelope transport system of the opening device in accordance with the present invention.
Figure 8:
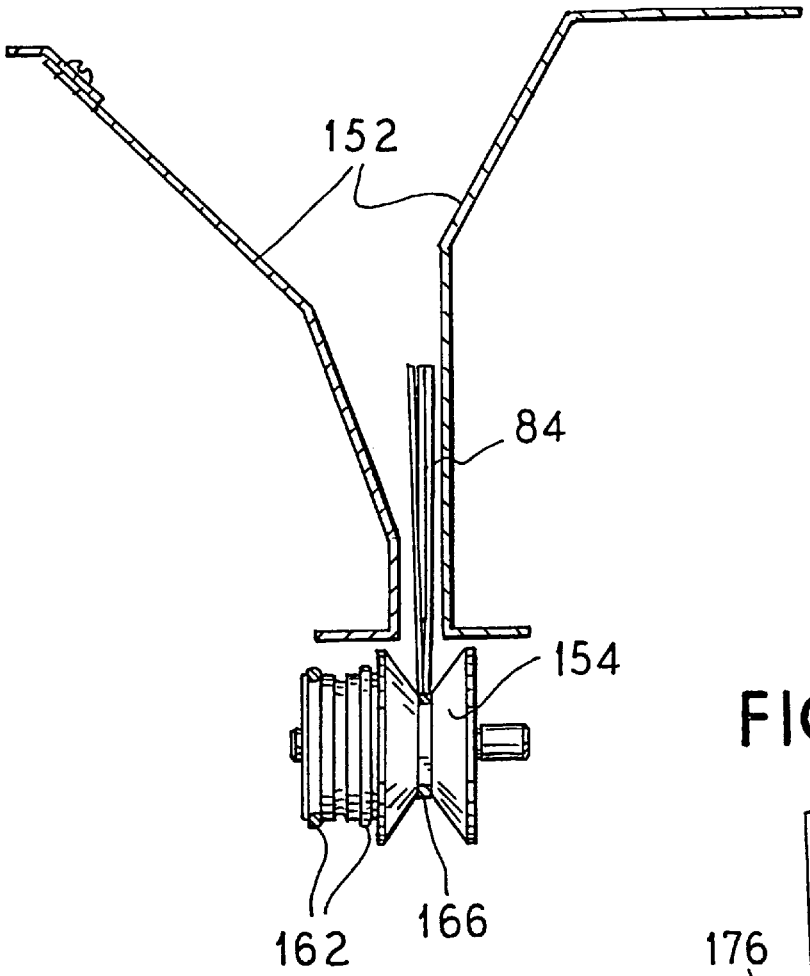
FIG. 8 is an end view of the drop rollers utilized to transport the envelope to the envelope extraction/opening device taken along the lines 8—8 of FIG. 7.
Figure 9:
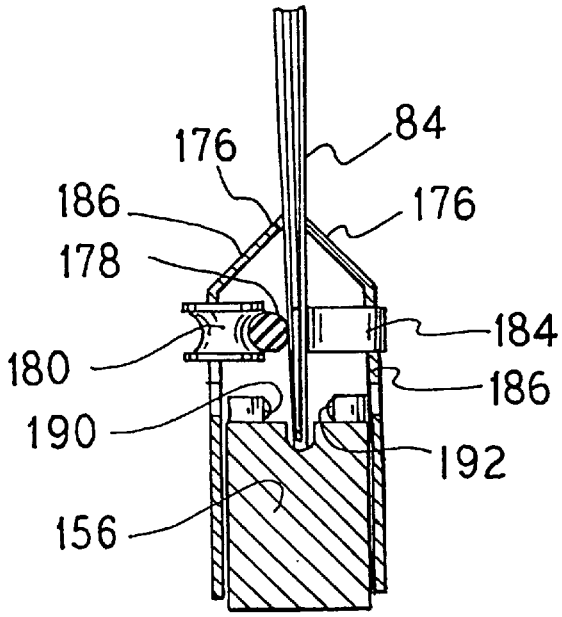
FIG. 9 is an end view partially in section of the envelope transport as utilized within the opening device taken along the lines 9—9 of FIG. 7.

Referring now to FIGS. 7, 8, and 9, the envelope transport system is schematically shown. The envelope transport system works in conjunction with the envelope opening/extraction assembly likewise disclosed schematically in FIG. 11. The entire envelope transport system, as schematically illustrated in FIG. 7, includes a first series of drop rollers 154 which end at a folder track bar 156, whose function will be described hereinafter. The drop rollers 154 are positioned in the bottom of the drop chute 152 as illustrated in FIG. 8 of the drawings.

Figure 11:
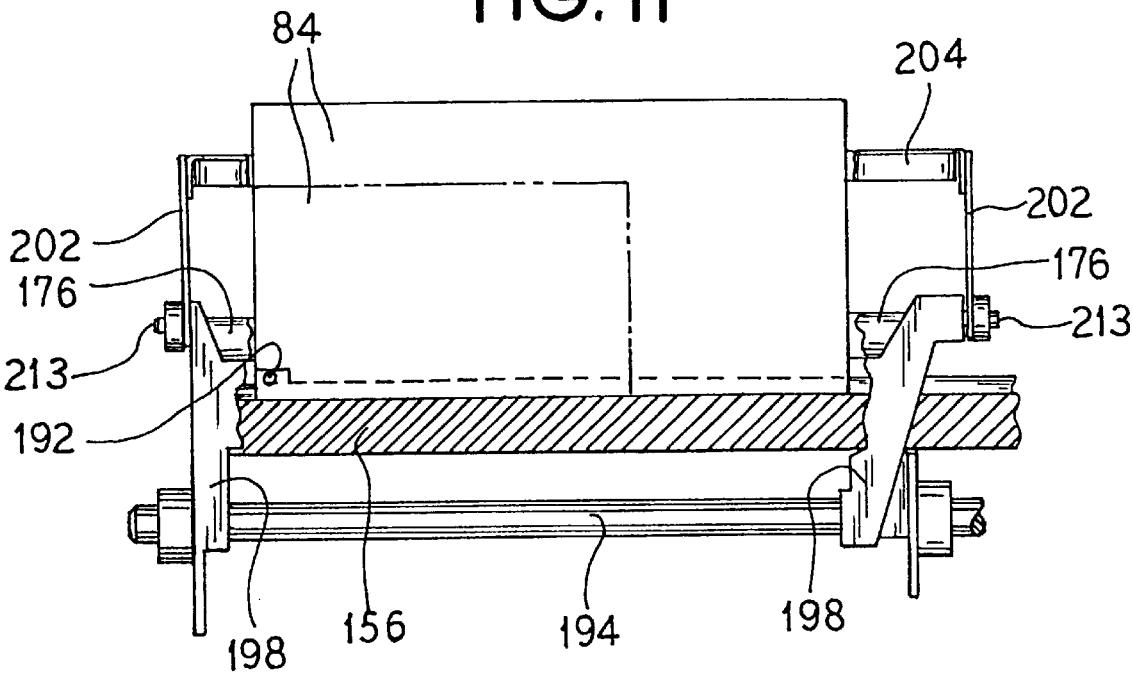
FIG. 11 is an end schematic view of a portion of the opening device of the present invention illustrating different sizes of envelopes.
Figure 12:
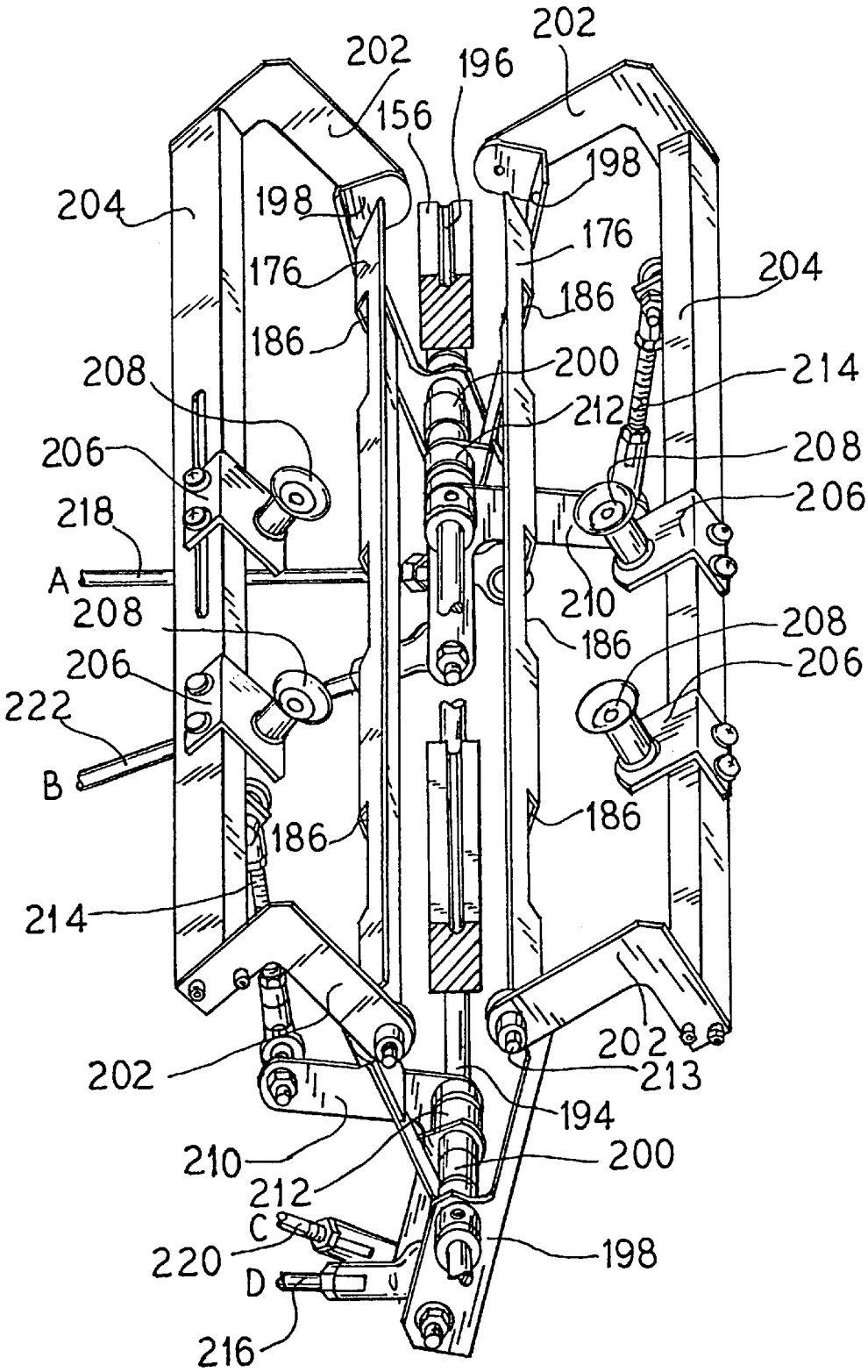
FIG. 12 is a top oblique view of the envelope extraction device of the present invention.

The track bar 156 and its associated assemblies comprising the remainder of the envelope transport system are positioned generally within the envelope opening mechanism as schematically illustrated in FIG. 11 and as shown in FIG. 12. FIG. 12 only illustrates the folder track bar 156 with the remainder of the transport system being omitted for the purposes of clarity of illustration of the operating mechanism of the opening assembly itself. The entire combined assembly of the envelope transport system associated with the folder track bar 156 and folder opening assembly, as illustrated schematically in FIG. 11 and as pictorially illustrated in FIG. 12, are positioned generally beneath the area of the follower block 78 and beneath the feed tray 74 as illustrated in FIG. 4. The exit or left hand end of the folder track bar 156 interconnects with a track trough 36 and its associated envelope track 160 again as shown in FIGS. 1–5 of the drawings and as to be described in greater detail in reference to FIG. 18 hereinafter.

The operation of the transport system of the envelope opener of the present invention will now be described in reference to FIGS. 7, 8 and 9. It is to be kept in mind that, as previously stated, the left hand portion of the transport system, as shown in FIG. 7, is operating in conjunction with and is interposed within or integrated within the opening mechanism as shown in FIGS. 11 and 12 of the drawings. This relationship of the envelope transport system as it is associated with the envelope opening/extraction mechanism shown in FIG. 12 will become apparent from the description of that portion of the transport system to be undertaken hereinafter.

Referring again to FIGS. 7–9 of the drawings and particularly to the right hand portion thereof, the transport system includes four drop rollers 154. Drop rollers 154 are appropriately journaled beneath the V-shaped drop chute 152. Each drop roller 154 includes two V-grooves therein and the four rollers are interconnected by belts 162, as shown in FIG. 7, with the first such roller 154 being interconnected to a drive motor 164. The drive motor 164 runs continuously and thus all four drop rollers 154 are continuously running. A high friction O-ring 166 is positioned within the deep v of the drop roller 154 to provide friction for the envelope 84 when envelope 84 falls through the drop chute 152 into engagement with the drop rollers 154. In this manner whenever an envelope 84 arrives at the drop chute 152, the envelope 84 is immediately moved forward toward the left hand portion of the transfer mechanism.

The transfer mechanism associated with the envelope opening mechanism includes four transfer belt pulleys 168, 170, 172 and 174 are positioned outside either end of the opening mechanism shown in FIG. 11, i.e., beyond either end of opposed folder blades 176. The folder transfer belt 178 is designed to run generally in alignment with and above the folder track bar 156 as generally illustrated in FIG. 9 and to likewise run through the concavity formed by the closure of the two folder blades 176 likewise as illustrated in FIG. 9.

Three stationary guide wheels 180 are appropriately journaled within the loop formed by the folder belt 178 and generally above the folder track bar 156 as shown in FIG. 9. A groove within the guide wheels 180 provides a raceway for the folder transfer belt 178 and provides the driving interface between the transfer belt 178 and an envelope 84 positioned within the folder track bar 178 again as illustrated in FIG. 9.

Appropriate pressure is maintained upon the opposite side of the envelope 84 from the folder transfer belt 178 by means of a series of spring loaded pressure wheels. At the entrance end of the folder track bar 156, there is an entrance pressure wheel 182 that is positioned in opposing alignment with the idler transfer belt pulley 168. Following thereafter and in alignment with the guide wheels 180 are three small pressure wheels 184. The stationary guide wheels 180 and small pressure wheels 184 are journaled in alignment with apertures 186 in the folder blades 176. As to be described hereinafter, as the folder blades 176 actuate inwardly and outwardly, the apertures 186 provide clearance between the folder blades 176 and the stationary guide wheels 180 and small pressure wheels 184. Finally, at the exit end of the folder track bar 156 and in alignment with idler transfer belt pulley 170, there is a spring loaded exit pressure wheel 188. The combination of the idler wheels and stationary wheels working in conjunction with the pressure wheels provides adequate pressure between the envelope panel and the folder transfer belt 178 to move the envelope 84 through the transfer mechanism when the folder transfer belt 178 is in motion. The transfer belt 178 is driven by an appropriate belt and pulley arrangement to an appropriate motor through drive transfer belt pulley 174.

A photocell light 190 and associated photocell 192 are positioned just in advance of idler transfer belt pulley 170. The photocell 192 is interconnected through an appropriate electronic circuit arrangement working in conjunction with the drive motor (not shown) which operates the folder transfer belt 178 to detect the presence of an envelope 84 as it moves along in the folder track bar 156 and stops operation of the drive motor. The drive motor may be any of a suitable type utilizing a quick reacting clutch and brake mechanism to quickly and accurately stop the transfer belt 178. As illustrated in FIG. 11, the length of the opening mechanism is designed in respect to the positioning of the photocell 192 such that the opening mechanism can accept small envelopes 84 or large envelopes 84 indiscriminately and their leading edge will always be positioned at the same leading point within the opening mechanism.

The electronic control circuitry for the envelope opening device, which is in operable communication with, and controlled by, the control device 18, is such that, upon startup, the drive motor operating the folder transfer belt 178 will be actuated in the event that there is no envelope 84 present within the opening mechanism and as sensed by the photocell 192. At this point, the feed tray mechanism 74 will operate the conveyor chains 76 to move the supply of envelopes 84 forward until a photocell there senses their presence at the feed station. Each gate around the envelope milling stations includes a photocell as well as a photocell in the drop chute area at the entrance end of the folder track bar.

The wheels associated with each wheelplate are continuously running as well as the conveyor belts and their associated milling wheels at each station. A gate assembly operates in a manner to restrain an envelope 84 at a particular gate from moving forward into the milling area until the gate is actuated, at which time the gate is raised. Raising the gate permits the envelope 84 to move underneath the pressure wheels associated with each transfer mechanism and through the miller assembly whereupon the envelope 84 then reaches the next set of continuously moving wheels and is transferred to the next gate assembly.

The control circuitry of the envelope opening device 14 is designed for a logic such that the absence of an envelope in the drop chute area or any gate will actuate the lifting of the immediately preceding gate to permit feeding of an envelope 84 to the drop chute area or through the preceding cutting mechanism or, in the case of the first gate, feeding from the supply hopper. In this way, the milling device 66 fills up entirely and there will always be an envelope positioned at every gate awaiting for its sequential transfer through the milling device 66 ultimately to the opening mechanism. As provided above, the control circuitry of the opening device 14 is operably connected to control device 18, preferably by at least one electrical connection. The sequential transfer of the envelope 84 through the system, and onto the envelope track 160, is ultimately controlled by the control device 14 using the control logic as provided above.

At the envelope extraction device or opening mechanism, an envelope 84, which has dropped into the drop chute 152, will immediately be brought up to the entrance end of the folder track bar 156. At this point, if the folder transfer belt 178 is not operating, the envelope 84 will simply come up against the folder transfer belt 178. The envelope 84 will remain there during the cycle of operation of the extraction device within which there will already be an envelope 84 sensed which will have caused the transfer belt to have stopped. Following the extracting/opening cycle of the envelope 84, as to be described hereinafter, the folder transfer belt control circuitry is actuated, thus moving the folder transfer belt 178 and exiting the opened envelope 84 out the exit end of the folder transfer bar onto the envelope track 160 as previously described.

As the transfer belt 178 begins its movement, the next following envelope 84, already present at the entrance end of the transfer track bar 156, will thus move into the transfer assembly until the photocell 192 is reached, at which point the folder transfer belt 178 will be stopped. Thereafter, the logic circuitry in operable communication with the control device 14 and as regulated by the photocells at the entrance end of the folder track bar 156 and the respective gates will cycle the gates to move the next envelope 84 through the system.

Figure 13:
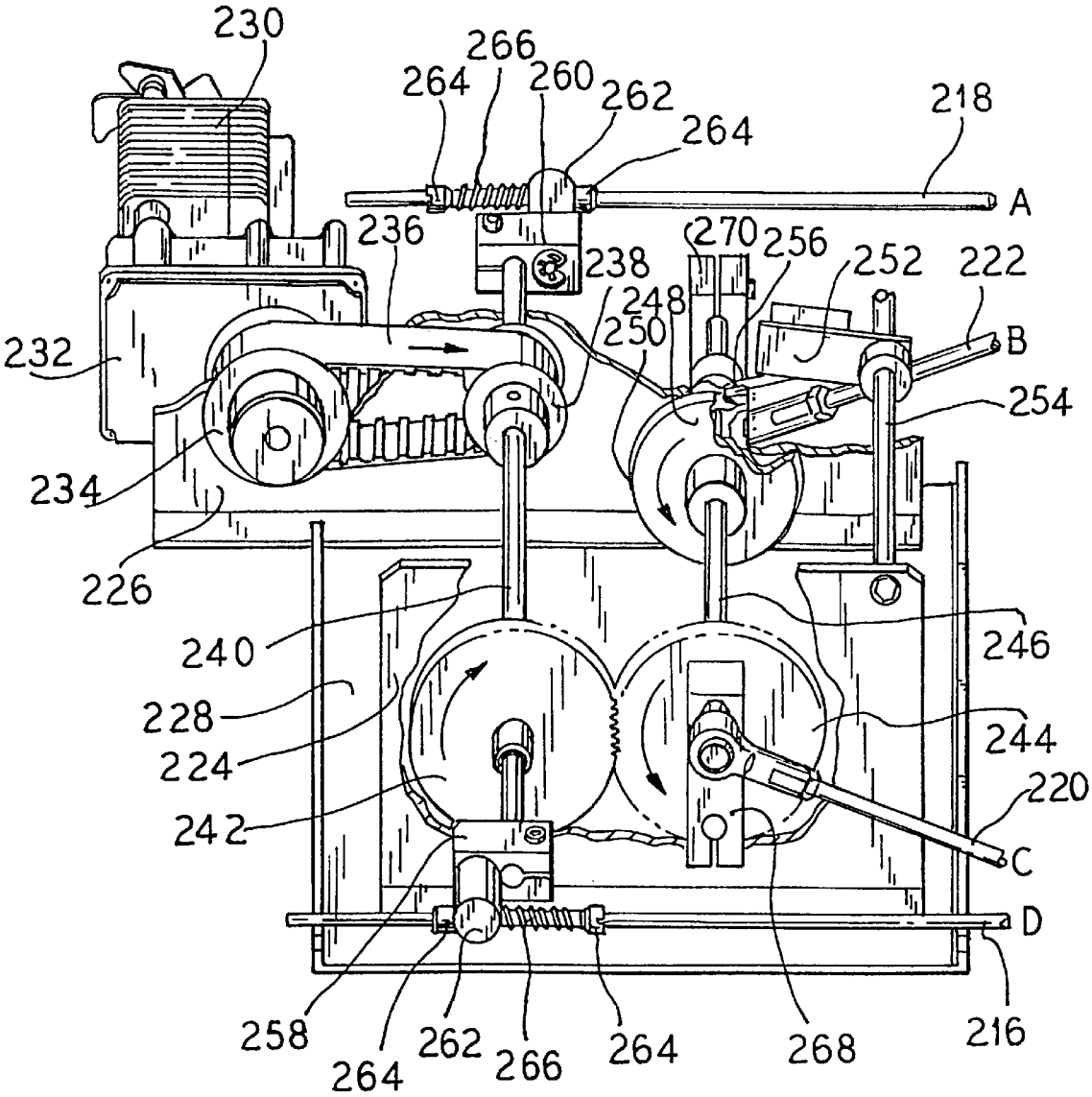
FIG. 13 is a top oblique view of the drive mechanism which operates the envelope extraction device of the present invention.
Figure 14:
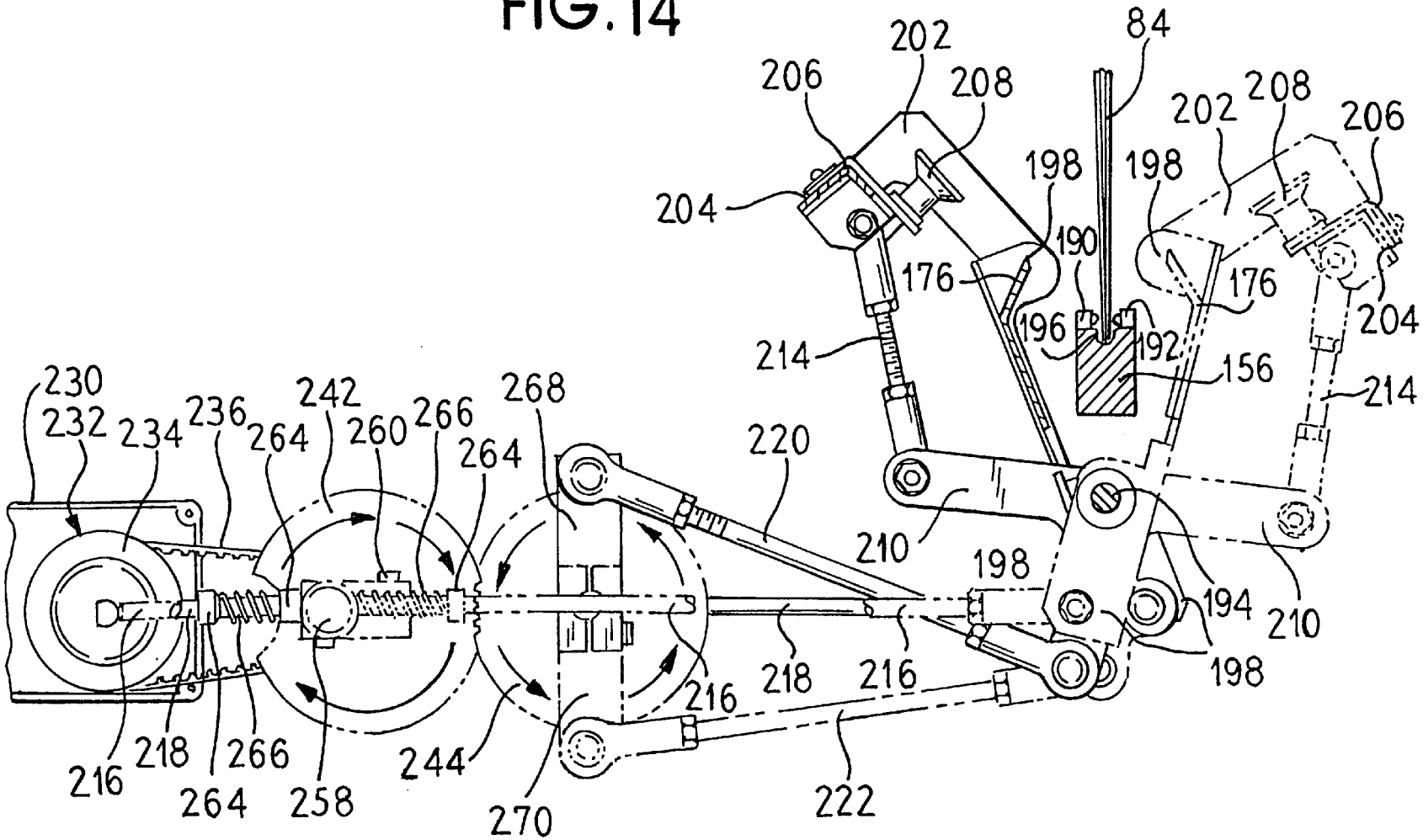
FIG. 14 is an end view partially in section through the envelope extraction device of the present invention showing the device at rest prior to commencement of the opening/extraction cycle.

The entire envelope extraction device and its drive assembly are shown in FIGS. 12 and 13 of the drawings but without the envelope transport system as earlier indicated. If FIG. 13 is placed to the left of FIG. 12 and the rods A, B, C and D interconnected, the entire assembly and its operating drive mechanism in their relative relationship to one another may be seen. FIGS. 12 and 13 show the envelope extraction device and its drive mechanism in an oblique perspective and in its rest position, i.e. that ready to receive an envelope 84 to be opened. FIG. 14 is a side sectional view of the envelope opening/extraction mechanism and drive assembly and should also be referred to in conjunction with FIGS. 12 and 13 for the description of the basic components of the system which follows.

Referring to FIG. 12, the extraction device includes a stationary folder shaft 194. Either end of the stationary folder shaft 194 is secured into vertical uprights which provide the basic support for the entire assembly. Likewise secured into the vertical uprights (not shown) and spaced slightly above the stationary folder shaft 194 is a stationary folder track bar 156. The folder track bar 156 includes a deep recess 196 therein which provides a track within which the unopened edge of the envelope 84 being opened passes in its travel through the system.

The milling device 66 is symmetrical and the left side portions thereof may be reversed or rotated and used on the right side. The only distinction is in that the system is in opposite to itself, i.e. the various parts moving in directions toward and away from each other, the various actuating mechanisms for the major components thereof will be operating in opposite directions for the left side versus the right side. This will become more apparent from the description of the opening mechanism which follows.

Journaled upon the stationary folder shaft 194 for each complementary part of the mechanism is a pair of folder blade pivot arms 198. Secured to the upper portion of the corresponding pairs of folder blade pivot arms 198 is a folder blade 176. The respective pairs of folder blade pivot arms 198 and associated folder blade 176, as previously stated, are of identical construction and are held in slight offset alignment to one another in the direction of the stationary folder shaft 194 by means of appropriate spacers 200.

At the upper end of each pair of folder blade pivot arms 198 are journaled for pivoting action a like pair of cup bar pivot arms 202. These L-shaped cup bar pivot arms 202 provide the support for a cup bar 204. The cup bar 204 carries laterally adjustable cup clips 206 to which there are secured pneumatic suction cups 208. The suction cups 208 are connected to an appropriate vacuum source through vacuum lines neither of which is shown.

The stationary folder shaft 194 also provides the journal for an L-shaped cup bar rocker arm 210 for each pair of cup bar pivot arms 202 and associated cup bar 204. Each cup bar rocker arm 210 for its associated assembly of cup bar pivot arms 202 and cup bar 204 are positioned one at each end of the stationary folder shaft 194 and are appropriately positioned with respect to the remaining assembly by means of a spacer 212.

The upper end of the cup bar rocker arm 210 is pivotally interconnected to the lower end of a cup bar connecting link 214. The upper end of the cup bar connecting link 214 is pivotally interconnected to the cup bar 204.

One of the two folder blade pivot arms 198 for each folder blade 176 extends below the stationary folder shaft 194 and provides a pivotal interconnection with a folder blade crank rod 216 associated with the folder blade pivot arm 198 for the right hand folder blade 176. In a like manner but positioned at the opposite end of the stationary folder shaft 194, the folder blade pivot arm 198 extends downwardly below the stationary folder shaft 194 and provides a pivotal interconnection with a second folder blade crank rod 218. The folder blade crank rods 216 and 218 operate in opposite directions during cycling of the opening mechanism. Thus, it will be appreciated that, as the crank rod 216 moves to the right, the folder blade pivot arm 198 will move the folder blade 176 toward the folder track bar and the envelope 84 positioned therein. In a like manner, retraction or movement of the folder blade crank rod 218 toward the left will likewise bring the left hand folder blade 176 to the right toward the envelope 84 and in converging relationship with its opposing folder blade 176. Reverse motion of the folder blade crank rods 216 and 218, of course, opens the folder blades 176 away from one another.

The lower end of each cup bar rocker arm 210 extends below the stationary folder shaft 194. Interconnected to the lower portion of the cup bar rocker arm 210 in a pivotable manner is a cup bar crank rod 220 associated with the left hand cup bar 204 and a second cup bar crank rod 222 associated with the cup bar rocker arm 210 for the right hand cup bar 204. Movement of the cup bar crank rod 220 toward the left will operate through the cup bar rocker arm 210 and cup bar connecting link 214 to pivot the left hand cup bar 204 inwardly toward the envelope 84. In a like manner, movement of the cup bar crank rod 222 toward the right will pivot the right hand cup bar 204 inwardly toward the envelope 84. Accordingly, there is a dual action occurring as the folder blade pivot arms 198 pivot inwardly toward one another, they carry with them the pivot points for the cup bar pivot arms 202 while, at the same time, the cup bar pivot arms 202 are themselves being pivoted upon the folder blade pivot arms 198 by the action of the cup bar rocker arms 210 and cup bar connecting links 214.

The sequential control of the pair of folder blade crank rods 216 and 218 and the cup bar crank rods 220 and 222 and thus their associated folder blades 176 and cup bars 204 is controlled through a drive mechanism as shown in FIG. 13. The drive mechanism includes a pair of shaft supporting walls 224 and 226 and appropriate floor member 228. A drive motor 230 with an appropriate brake and clutch mechanism 232 is secured to the support wall 226 and drives through a drive pulley 234 and a drive belt 236. The drive belt 236 operating through a drive pulley 238 provides the power to a folder blade crank shaft 240.

The folder blade crank shaft 240 carries thereon a folder blade crank shaft gear 242. The folder blade crank shaft gear 242 mates with and drives a cup bar shaft gear 244 of equal number of teeth. The cup bar shaft 246 in turn has disposed thereon and rotating therewith a microswitch cam shaft 248. A cam shaft detent 250 is positioned on the outer circumference of the microswitch cam 248. A microswitch 252 is supported upon a support rod 254 above the microswitch cam 248 and its cam follower 256 rides along the outer circumference of the microswitch cam 248 and is actuated upon sensing the detent 250.

The folder blade crank shaft 240 has positioned on either end thereof oppositely directed folder blade crank arms 258 and 260. The crank arm 258 is pivotally interconnected through a pivot pin 262 to folder blade crank rod 216, whereas the folder blade crank arm 260 is connected through a like pivot pin 262 to folder blade crank rod 218. Each folder blade crank arm 258 and 260 and their associated pivot pins 262 are slid and bolted upon their respective folder blade crank rods between adjustable collars 264 upon which are positioned dwell springs 266 interposed between the pivot pins 262 and one of the collars 264. The operation of the dwell springs 266 will be described hereinafter.

The cup bar shaft 246 has oppositely directed cup bar crank arms 268 and 270 upon its opposite ends. Cup bar crank arm 268 is pivotally interconnected to cup bar crank rod 220. In a like manner, cup bar crank arm 270 is pivotally interconnected to cup bar crank rod 222.

The envelope opening device 14 and its drive assembly, as shown in FIGS. 12, 13 and 14, are at the address or position ready to receive an envelope 84 to be opened. In the sequence of events, the envelope 84 transfer assembly is operating and an envelope 84 is brought into the opening assembly until the photocell is engaged, whereupon the transfer mechanism is stopped. At that moment, drive motor 230, which is continuously operated, is engaged through clutch 232 to drive the drive belt 236 in the direction of the arrow thereupon with consequent driving of the folder blade crank shaft 240 and cup bar shaft 246 as well as their associated crank arms, all of which, in turn, move their associated crank rods. At this point, folder blade crank rod 218 begins to move to the left as the folder blade crank arm 260, through its associated pivot pin 262, begins to engage dwell spring 266. In a like manner, folder blade crank rod 216 begins to move to the right. As this occurs, the folder blades 176 begin converging together in the opener assembly.

Simultaneously, cup bar crank rod 222, through the associated action of its cup bar crank arm 270, begins to move to the right while cup bar crank rod 220 begins to move to the left. As this action is occurring, the cup bar rocker arms 210 will begin to pivot the cup bars 204 toward one another through the action of cup bar connecting links 214 and toward engagement with the envelope 84.

FIGS. 14, 15, 16 and 17 illustrate four distinct points in the full cycle of 360° of the four crank arms associated with the opener drive mechanism. In each of these FIGS. 14–17, the crank arms and associated crank rods, pivot arms and rocker arms as well as folder blades and cup bars for the left hand portion of the symmetrical assembly are shown in solid lines whereas those associated with the right hand portion of the assembly are shown in phantom lines.

Figure 15:
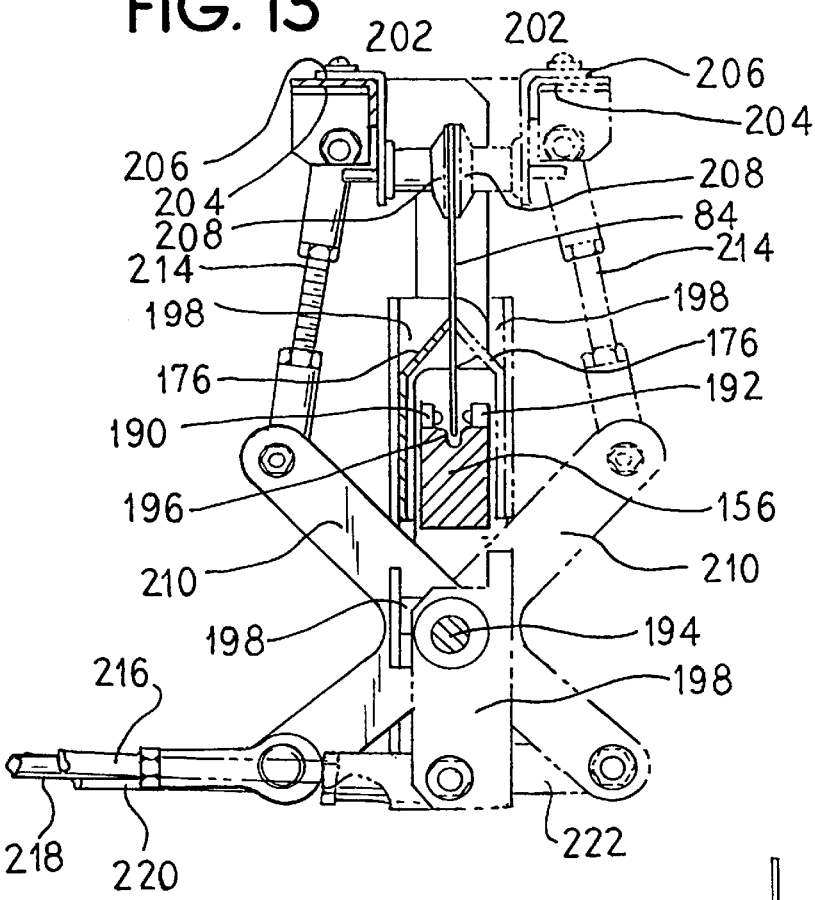
FIG. 15 is an end view partially in section through the envelope extraction device of the present invention at its 90° point in its cycle at which the envelope folder blades and grasping members are in engagement with the envelope panels prior to opening.

Referring now to FIG. 15, the crank arms have rotated in the direction of the arrow as shown in FIG. 13 to their 90° point. At this point, the folder blades 176 have just come into engagement with the panels of the envelope 84, and the contents 52 therein, to provide a clamping action thereupon. Simultaneously, the folder blade pivot arms 198 carrying the folder blades 176 have moved to their vertical position, wherein the pivot points 213 for the cup bar pivot arms 202 have moved into concentric alignment with one another.

As best shown in FIG. 11, this pivot point 213 is slightly below the upper edge of the folder blades 176 by a distance of approximately ⅛". Further yet, at the cycle point shown in FIG. 15, the cup bar rocker arms 218, working through the cup bar connecting links 214, have brought the suction cups 208 into engagement with the upper portion of the envelope 84. At this point or slightly before, the control circuitry introduces vacuum to the suction cups 208.

At the 90° crank arm position, as shown in FIG. 15, the folder blade crank arms 258 and 260 will have assumed a 90° position. At this point, the pivot pins 262 will have moved the folder blade crank rods 216 and 218 against the compression of the dwell springs 226 to the point of closing of the folder blades 176 before any appreciable compression of the dwell springs 266.

The drive mechanism for the opener shown in FIG. 13 operates on a one continuous complete cycle of 360° at a continuous rotational velocity. Accordingly, the action of the mechanism going from the rest position in FIG. 14 through the positions in FIGS. 15 and 16 and finally arriving back to an opened and rest position shown in FIG. 17 is one continuous action.

As the crank arms continue to rotate from their 90° position shown in FIG. 15, the folder blades 176 continue to maintain their clamping action upon the envelope panels. However, as rotation continues beginning at the 90° point, the opposite actions of cup bar crank rods 220 and 222 will begin to operate through their respective cup bar rocker arms 210 to draw away the cup bars 204 and their associated suction cups 208. As this occurs, the envelope panels gripped by the suction cups 208 will likewise be drawn away with the cup bars 204.

However, at this time, the continued rotation of the folder bar crank arms 258 and 260 have no effect, in that the pivot pins 262 will now begin to compress the dwell springs 266. Compressing the dwell springs 266 does not cause any movement of the folder blades 176 except that, as the increased compression occurs to a maximum point of the 180° point of revolution of the crank arms, pressure on the folder blades 176 will increase. As these cranks begin to move toward their 270° point, the folder blades 176 will continue to be maintained in engagement with the envelope 84 all the way until the 270° point. At the 270° point, compression of the dwell springs 266 will have been substantially dissipated. Thus, the clamping action of the folder blades 176 upon the envelope 84 is constant from a position beginning at approximately 90° of position of the crank arms through and until at least the 270° point.

Figure 16:
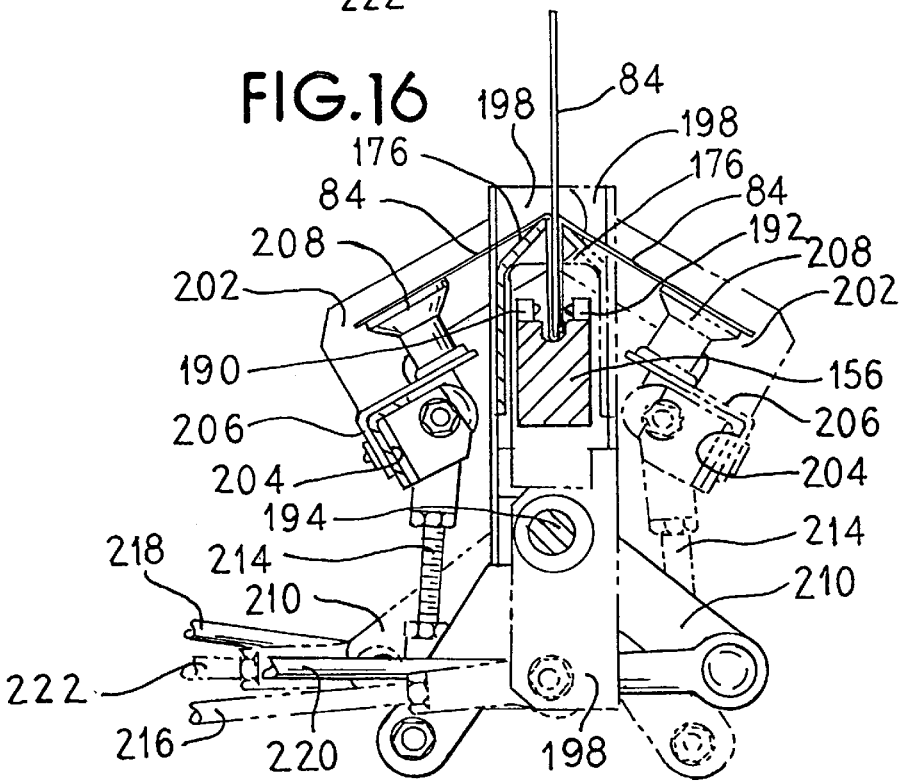
FIG. 16 is an end view partially in section through the envelope extraction device of the present invention at its 270° point in its cycle of operation, illustrating the envelope panels being pulled into taut relationship with the envelope folder blades providing the envelope crease.
Figure 17:
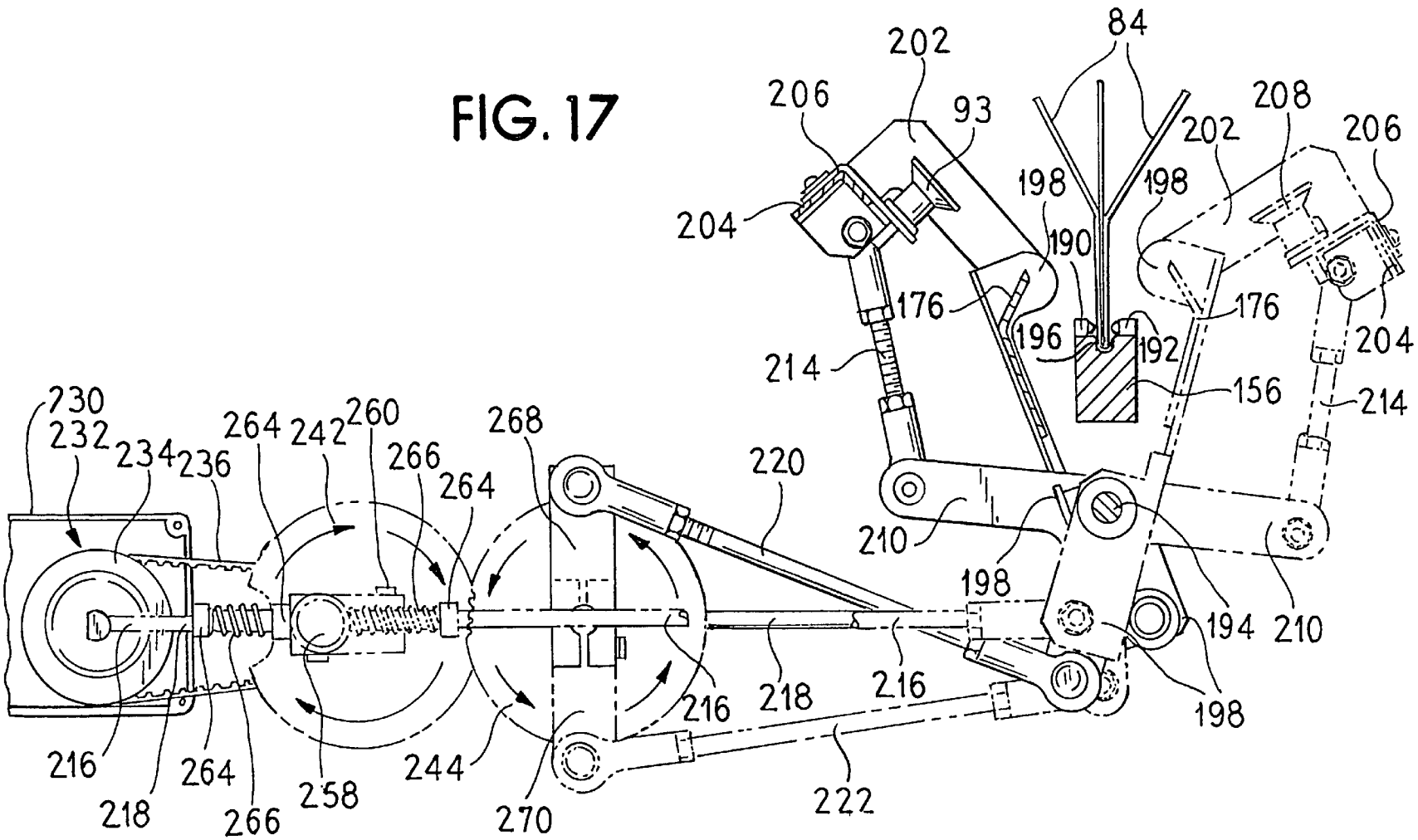
FIG. 17 is an end view partially in section through the envelope extraction device of the present invention illustrating the envelope apparatus having returned to its 360° or 0° rest position and illustrating the envelope with deflected and creased side panels following the envelope extraction operation.

Referring now to FIG. 16, there is shown in the interrelationship of the various components of the envelope opener at the 270° cranked position. Again, the folder blades 176 are still in engagement with the panels of the envelope 84. At this 270° point, the cup bar 204 and its associated suction cups 208 have reached their maximum angle of separation. This totally included angle is approximately 240°. At this point, the suction cups 208 have exerted a downward force upon the envelope panels creating a creasing action of the panels at the juncture of the upper edges of the folder blades 176. During this action, due to the large included angle upon which the envelope panels are separated, any tendency of the contents 52 within the envelope 84 to stick to the panels is measurable, inasmuch as the contents 52 simply cannot withstand this full downward angle and if they were initially adhering thereto, they will break loose and spring back up into general vertical alignment.

A significant aspect and feature of the milling device 66 of the present invention is the positioning of the pivot point 213 for the cup bar pivot arms 202 in respect to the upper edge of the folder blades 176. As previously indicated, these pivot points 213 associated with each folder bar pivot arm 198 and cup bar pivot arm 202, when in the position from 90° to 270°, are concentric with one another but spaced below the upper edge or data plane of the folder blades 176 by approximately ⅛". The effect of such arrangement is that, as the cup bar pivot arms 202 rotate from the 90° cranked position as shown in FIG. 15 to the 270° position as shown in FIG. 16, the pivotal arc of the cup bar pivot arms is not around the upper edge of the folder blades, but below the same and thus is a diverging arc which pulls the panels away from the point at which they are clamped between the folder blades 176. This diverging arc creates tension in the panels thus creating a greater creasing effect of the envelope panels at the clamping point of the folder blades 176.

As the respective crank arms now begin to move from the 270° point back toward the 360° or zero rest point, the compression upon the dwell springs 226 reaches zero and the pivot pins 262 then engage the collars 264 and the folder blades 176 begin to retract away from the envelope panels. Simultaneously, the microswitch cam follower 256 drops into the microswitch cam detent 250 signaling the reaching of the 270° point. At this point, the vacuum to the suction cups 208 is released, and the suction cups 208 vented to atmospheric pressure, thus releasing their grasp upon the envelope panels. Additionally, a timing function of approximately 200 milliseconds is initiated.

Simultaneously, the crank arms associated with the cup bar crank rods also begin to operate through the cup bar rocker arms 210 and associated cup bar connecting links 214 to return the cup bars 204 to their generally upwardly disposed position as shown in FIG. 14. After the 200 millisecond timeout has occurred, the clutch 232 on the drive motor 230 associated with the drive system is disengaged and a brake is actuated. At this point, the entire opening mechanism has returned to the position shown in FIG. 17 which is identical to the position which the mechanism assumed at the initial beginning point of the opening cycle as shown in FIG. 14 with the exception that the envelope 84, as illustrated in FIG. 17, has now had its panels creased with a permanent deforming crease. At this point, the contents 52 of the envelope 84 are standing essentially vertically and the opposing panels are maintained permanently in an opened position permitting easy access of the contents.

Upon timing out of the 200 millisecond timing function and return of the opening mechanism to that position shown in FIG. 17, the envelope transport system, and particularly the motor operating the folder transfer belt, is energized. As this occurs, the envelope 84 which is grasped within the transport system is moved along the folder track bar out of the opening mechanism.

Figure 18:
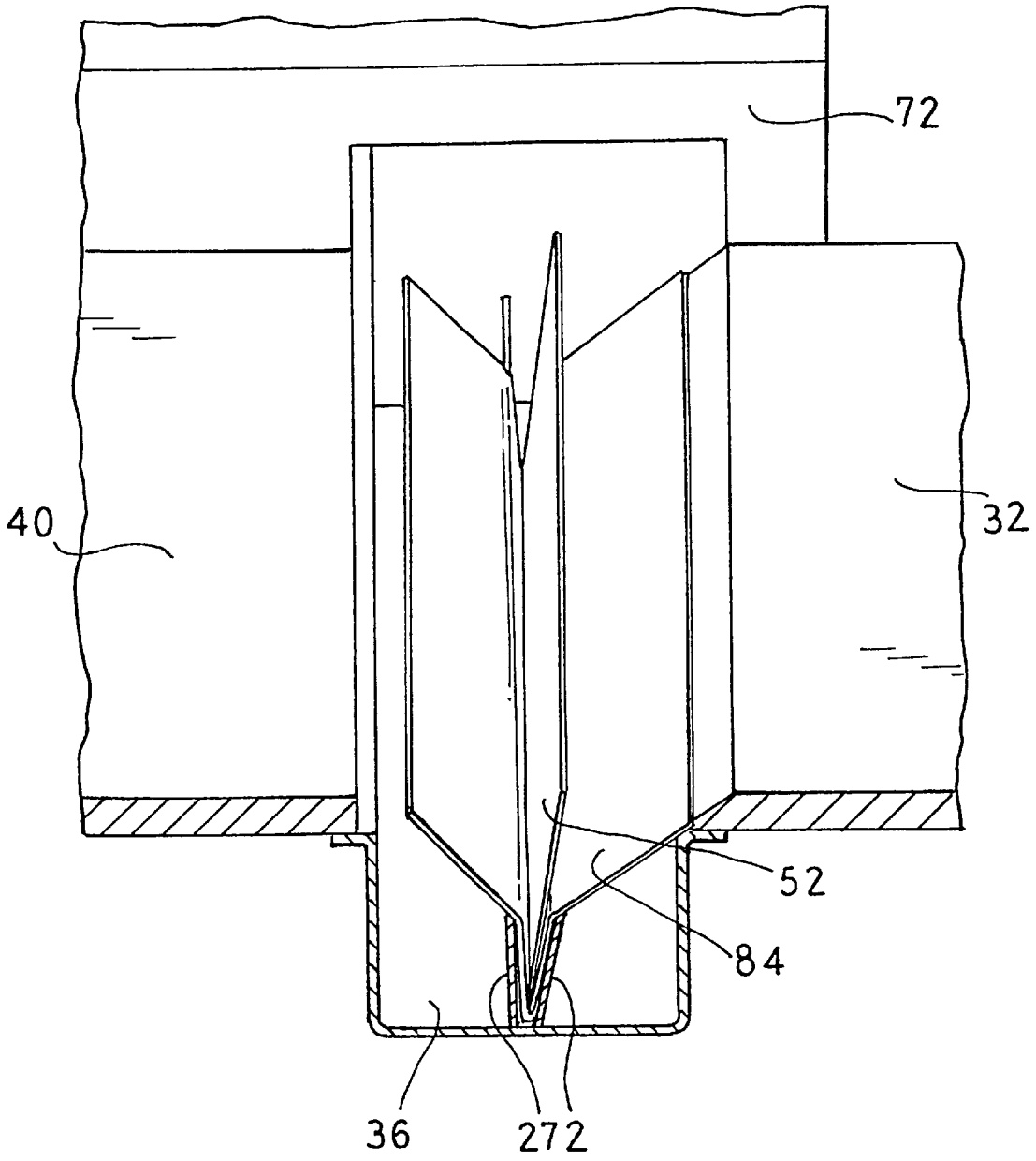
FIG. 18 is an oblique view of the envelope track of the envelope extraction device of the present invention into which envelopes pass following their extraction operation and illustrating an opened envelope and its contents exposed therein.

Referring now to FIG. 18, there is illustrated a cross section of the track trough 36 and envelope track 272 which are positioned below and in between the front edge 32 and back edge 40 of the workstation 12. The track trough 36 and associated envelope track 160 extend throughout the length of the workstation with its right hand portion proximate side edge 26 engaging the exit end of the folder track bar of the envelope opening system. The left hand end of the track trough 36 and envelope track 160 extend to just short of the side edge 24. At this point, there is an opening downwardly through the surface which is in communication with the empty envelope receptacle 51.

As envelopes 84 sequentially come into the opening device 14, become opened and are discharged therefrom, each successive envelope 84 will be pushed against its preceding envelope 84. As this sequence continues to occur, the envelopes 84 will move along the envelope track 36 in end to end relationship with their envelope edges creased opened and the contents thereof readily exposed for ease of extraction.

As a further advantage to viewing of the exposed contents of the envelope 84, the envelope track 160 is of a general V-shaped configuration. However, the right hand side of the V, as shown in FIG. 18, is inclined 10° to the right from vertical. This permits the envelopes 84 to be canted toward the front edge 32 to further enhance the view of the contents 52 of the envelope 84.

While the above discussed extraction device is preferred, other extraction devices are contemplated, including, but not limited to, an air flow device or a vacuum device among any other suitable extraction device. As provided, an alternate extraction device could comprise an air flow device aligned with at least one edge of the opened envelopes 84. The air flow device produces a flow of air across the envelope 84, spreading the opposed sides of the envelope 84 apart so that the contents 52 thereof are exposed for extraction. This airflow device would work best with an envelope 84 cut only on the longitudinal edge, whereby, when the airflow encounters the envelop 84, the opposed sides would separate forming a pocket.

Alternately, the extraction device could comprise a vacuum device that engages opposing sides of the opened envelopes 84 so that the contents thereof are exposed for extraction. This device would work well with an envelope 84 opened on one, two or three sides.

In one embodiment of system 10 employing vacuum device as the extraction device, an envelope 84 is conveyed past a extraction head on a vacuum device, with a suction cup mounted in the extraction head. In this embodiment, the suction cup entrains one opposed face of the envelope 84, referred to as the leading face. As the envelope 84 passes horizontally through the extraction device, the extraction head rotates so that the leading face entrained by the suction cup is peeled away from the contents 52.

While not depicted, it is contemplated that system 10 include a number of other devices in operable communication therewith to assist the operator in remit processing while maintaining transactional integrity. It is contemplated that opening device 14 could include an envelope preparation device and/or a verification device in operable communication therewith.

While many embodiments are contemplated for the envelope preparation device, a selection of suitable devices includes a jogging device, a sorter or even a metal detector.

A jogging device is a device in operable communication with the opening device 14 that imparts a jogging motion to the envelopes 84 prior to opening. This jogging motion assures that the contents 52 are moved away from the at least one edge that is to be opened. A sorting device on the other hand sorts the envelopes 84 based on size prior to opening.

The sorting device assures that only envelopes 84 having a predetermined size are provided to the opening device 14. One example of such a sorting device is a thickness measuring device, which could consist of a pair of opposed pressure rollers. The thickness measuring device determines or measures the thickness of the envelopes 84, so that only envelopes 84 having a predetermined thickness are provided to the opening device 14. Finally, the envelope preparation device could comprise a metal detector to determine if contents 52 include any metal, staples for example. Those envelopes 84 containing metal would not be provided to the opening device 14 and would be processed in some other manner.

As discussed previously, system 10 could also include a verification device in operable communication therewith, whereby the opened envelopes 84 are scanned to verify all the contents 52 have been extracted. One example of such a verification device is a candling device operably connected to at least the control device 18.

Candling devices would operatively check the emptied envelopes 84 at various locations in system 10 to make sure that each envelope 84 has been completely emptied, irrespective of its size and the contents 52, in one preferred embodiment in operable communication with control device 18. The candling devices or series of candling devices preferably operate to periodically check the envelope 84 across its length, as the envelope 84 progresses through the system 10, and to assign a weighted value to the detected reductions in transmitted light, which enables the actual contents 52 to be distinguished from markings or structural features of the envelope 84.

The candling device includes a series of sensors, preferably comprised of a series of photocells, capable of detecting changes in light as the envelopes 84 are passed across. Rather than relying upon ambient illumination of the sensors, it is preferred that the sensors be illuminated by a light source positioned directly over or across from the sensors. Such controlled illumination of the sensors serves to enhance the accuracy of the candling device, as distinguished from ambient illumination which is subject to variation.

Alternatively, a tactile cancelling device would be employed, in one preferred embodiment located on the envelope track 272 and in operable communication with the control device 18. Such device would tactilly determine the thickness of the envelopes, 84, using pressure rollers or other suitable devices. any envelopes 84 having a detected thickness greater than a predetermined amount would indicate contents 52 remain therein.

A printer may also be employed, preferably in operable communication with the control device 14 by means of an electrical connector. The printer is connected along the path of movement of the envelopes 84 for printing selected information on selected documents. For example, the printer may be utilized to print batch identification information such as a batch number, a transaction number and a document number on selected documents, checks or remit documents, in response to the batch identification pieces conveyed along the path of movement.

While many modes of operation are contemplated, including operating system 10 in a check scan or document scan mode only, one preferred method of processing the contents 52 of a plurality of envelopes 84 is described below. One skilled in the art will recognize that the preferred method may be modified or deviated from without effecting the process.

Figure 19:
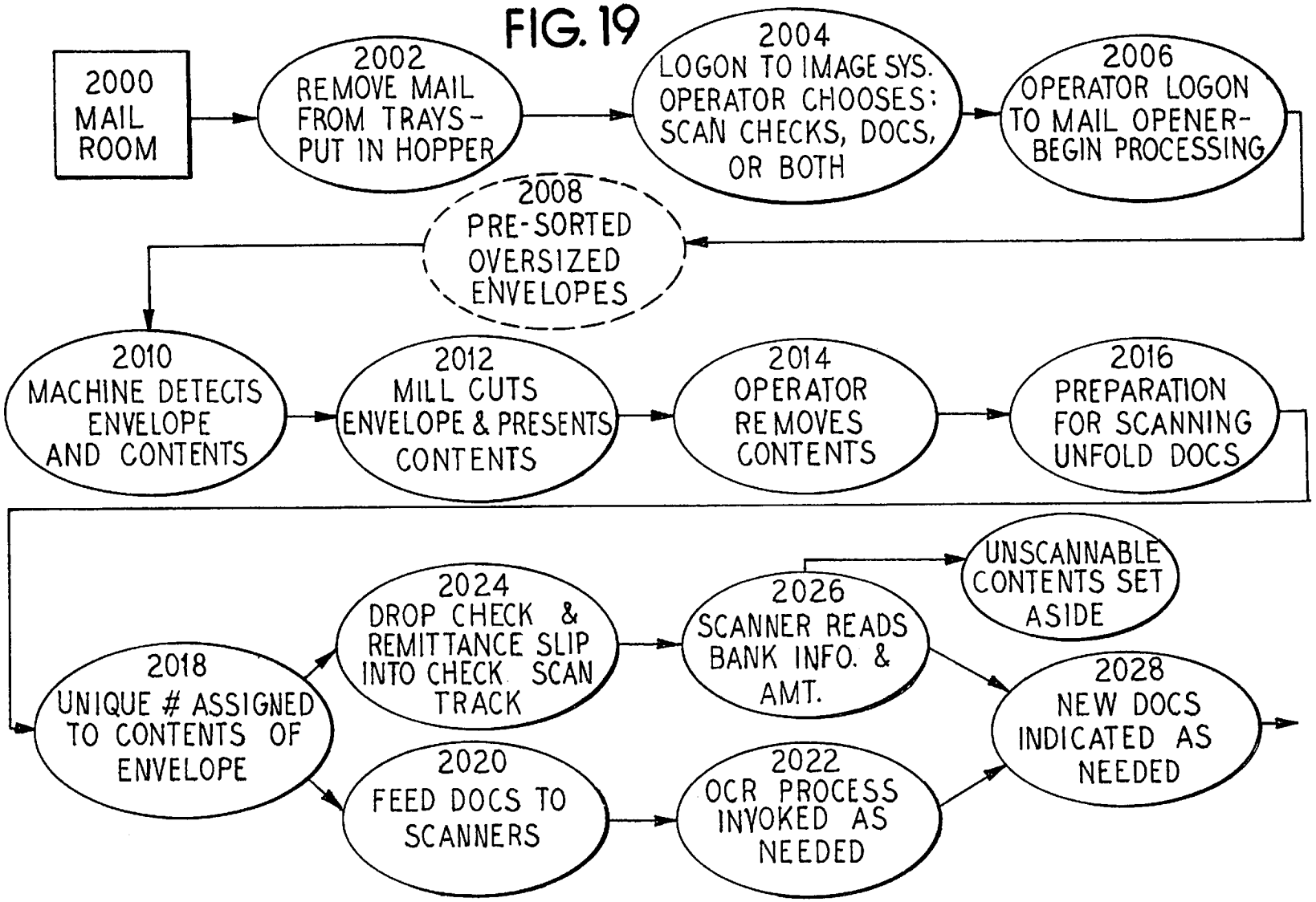
FIG. 19 is a flow diagram that schematically represents one method of processing documents, checks and remit documents.

Turning now to FIG. 19, the mail room delivers the envelopes 84 to the system 10 as shown in step 2000. In step 2002, the envelopes 84 are removed from the trays and placed in feed tray 74. The operator logs onto the system 10 and opening device 14 and, using keyboard 50, selects the proper mode as shown in steps 2004, 2006.

As described above, the envelopes 84 may be prepared as shown at step 2008 prior to opening. Preparing the envelopes 84 could include imparting a jogging motion, sorting the envelopes 84 according to size, measuring envelope 84 thickness and detecting any metal.

Once presorting is accomplished, if at all, the envelopes 84 are opened on one, two or three sides forming opened envelopes, but in one preferred embodiment the envelopes 84 are opened on three sides. At step 2010, the opening device 14 detects the envelopes 84 and opens the envelopes 84 on least one edge, exposing the contents 52 thereof (step 2012). Step 2012 includes opening the envelopes 84 on at least two sides forming envelope panels, providing at least a partial crease along a line of at least one of the envelope panels and deforming it, and clamping the opened envelopes 84 in a clamping device between which the opened envelopes 84 are disposed, among other extraction methods discussed above.

In step 2014, the operator extracts the exposed contents 52 and prepares them for scanning, i.e., step 2016. Preparing the contents 52 includes unfolding the documents, reorienting and repositioning the checks and remit documents, etc. Step 2018 shows that a unique number is assigned to the contents 52 of each envelope 84 by the control device 18 as the image of the extracted contents 52 are acquired by the image acquisition device 16 and stored in digital form.

When the documents, the checks or remit documents are presented to the optical scanner 54 as shown in step 2020, the control device 14, using control logic, opens a file in the database and assigns a unique number thereto. Step 2022 provides that an OCR process may be invoked as needed.

As described above, after the documents are presented to the optical scanner 54, any check and/or remit documents may be presented to the check/remit scanner 56 as provided in Step 2024. The scanner 56 reads the bank information and check amounts and stores that information as data in the database (Step 2026). Any unreadable documents are set aside for processing.

Finally, in Step 2028, any new documents from next envelope 84 are prepared and presented to the image acquisition device 16. Again, as provided above, as the image of the contents 52 by one envelope 84 are acquired, Steps 2010 through 2028 are repeated so that a next envelope is opened, a new file is created, and a new file number assigned.

It will be readily apparent from the foregoing detailed description of the invention and from the illustrations thereof, that numerous variations and modifications may be effected without departing from the true spirit of the novel concepts or principles of this invention.

We claim:

1. A system for processing the contents of a plurality of envelopes, comprising:

an opening device for opening the envelopes on at least one edge forming opened envelopes, and exposing the contents thereof for extraction;

an image acquisition device in operable communication with said opening device to acquire an image of the contents and store said image in digital form in a file in a database;

a control device including control logic, comprising software, operably connected to at least said opening device and said image acquisition device, whereby said image of the contents are acquired from one envelope, a next envelope is opened by said opening device, and a new file is created in said database; and an operational control device operably connected to at least said control device, whereby a mis-scanned image may be corrected.

2. The system of claim 1 wherein said control device assigns all the contents from one envelope into a single distinct transaction.

3. The system of claim 2 further wherein said control device assigns said single distinct transactions into selected batches of transactions.

4. The system of claim 1 wherein said opening device comprises a slitting device, whereby the envelopes are slit on at least one edge forming said opened envelopes.

5. The system of claim 1 wherein said opening device comprises an edge severing device, whereby the envelopes are severed on at least one edge forming said opened envelopes.

6. The system of claim 1 wherein said opening device comprises a milling device that opens the envelopes on at least one edge forming said opened envelopes.

7. The system of claim 6 wherein said milling device opens the envelopes on at least a leading edge and a longitudinal edge.

8. The system of claim 1 wherein said opening device includes an extraction device, whereby the contents are exposed for extraction.

9. The system of claim 8 wherein said extraction device comprises a vacuum device that engages opposing sides of said opened envelopes, whereby the contents are exposed for extraction.

10. The system of claim 8 wherein said extraction device comprises a clamping device between which the envelopes are disposed.

11. The system of claim 10 wherein said clamping device comprises opposed elongated folder blades pivoted upon a first common axis between which the envelopes are disposed.

12. The system of claim 11 wherein said folder blades each include an envelope panel engagement edge which are aligned when said envelope panel engagement edges engage opposite sides of the envelopes.

13. The system of claim 12 wherein said clamping device further comprises opposed elongated grasping members disposed parallel to said folder blades and pivotable upon a second axis and between which the envelopes are disposed.

14. The system of claim 1 further comprising an envelope transport device in operable communication with at least said opening device for serially delivering said opened envelopes so that the contents thereof maybe extracted.

15. The system of claim 1 further comprising an envelope preparation device in operable communication with said opening device.

16. The system of claim 1 wherein said control device includes at least one nonvolatile storage medium for storing said digital images in a database for subsequent remittance processing.

17. The system of claim 16 wherein said control device further includes at least one microprocessor with said at least one nonvolatile storage medium operational thereon, operably connected to at least said opening device and said image acquisition device.

18. The system of claim 1 wherein said operational control device comprises a foot pedal connected to at least said control device, whereby when said foot pedal is depressed, said image in said database is deleted, an image of the contents is reacquired and a new digital image is stored.

19. The system of claim 1 wherein said control device comprises first and second microprocessor control devices each having control logic operational thereon, said first microprocessor control device operably connected to at least said opening device and said second microprocessor control device operably connected to at least said image acquisition device.

20. The system of claim 19 wherein said control logic operating on said first microprocessor control device comprises software, whereby when the contents are extracted from one envelope, said opening device is instructed to open a next envelope.

21. The system of claim 20 further including a detection device that detects when the contents are extracted from said envelope.

22. The system of claim 21 wherein said detection device comprises at least one light source and light detector in operable communication with said first microprocessor control device.

23. The system of claim 19 wherein said control logic operating on said second microprocessor device comprises software, whereby said image of the contents are acquired and stored in digital form in said file.

24. The system of claim 23 further including an operational control device in operable communication with at least said second microprocessor control device, whereby when said image of the contents are acquired and stored in digital form in said file, said operational control device is activated and said file is closed.

25. The system of claim 24 wherein said operational control device comprises a foot pedal.

26. The system of claim 24 wherein said second microprocessor control device further includes at least one nonvolatile storage medium operational thereon for storing said images.

27. The system of claim 1 wherein said image acquisition device comprises at least one optical reader for acquiring images of the contents.

28. The system of claim 27 wherein said at least one optical reader comprises a page scanner.

29. The system of claim 27 wherein said at least one optical reader comprises a remittance document scanner.

30. The system of claim 29 wherein said at least one optical reader further comprises a page scanner.

31. The system of claim 29 wherein said remittance document scanner comprises a magnetic image character reader.

32. The system of claim 1 further comprising an alphanumeric keypad operably connected to at least said control device for data entry.

33. The system of claim 1 further comprising a verification device, whereby it is determined that all the contents have been extracted from said opened envelopes.

34. The system of claim 33 wherein said verification device includes a candling device operably connected to said control device.

35. The system of claim 1 including a printing device in operable communication with said control device for printing selected information on the contents.

36. A system for processing the contents of a plurality of envelopes, comprising:

a milling device for opening the envelopes on at least two edges forming opened envelopes, and exposing the contents thereof for extraction;

an image acquisition device in operable communication with said milling device to acquire an image of the contents and store said image in digital form in a file; and a control device including control logic operably connected to at least said milling device and said image acquisition device, whereby when said image of the contents are acquired from one envelope, a next envelope is opened by said milling device and a new file is created; and an operational control device operably connected to at least said control device, whereby a mis-scanned image may be corrected.

37. The system of claim 36 wherein said control device assigns all the contents from one envelope into a single distinct transaction.

38. The system of claim 37 further wherein said control device assigns said single distinct transactions into selected batches.

39. The system of claim 37 wherein said milling device opens the envelopes on at least a leading edge and a longitudinal edge.

40. The system of claim 39 wherein said milling device includes an extraction device, whereby the contents are exposed for extraction.

41. The system of claim 40 wherein said extraction device comprises a vacuum device that engages opposing sides of said opened envelopes, whereby the contents are exposed for extraction.

42. The system of claim 40 wherein said extraction device comprises a clamping device between which said envelopes are disposed.

43. The system of claim 42 wherein said clamping device comprises opposed elongated folder blades pivoted upon a first common axis between which said envelopes are disposed.

44. The system of claim 43 wherein said folder blades each include an envelope panel engagement edge which are aligned when said envelope panel engagement edges engage opposite sides of said envelopes.

45. The system of claim 44 wherein said clamping device further comprises opposed elongated grasping members disposed parallel to said folder blades and pivotable upon a second axis and between which said envelopes are disposed.

46. The system of claim 45 comprising an envelope transport device in operable communication with at least said milling device for serially delivering said opened envelopes so that the contents may be extracted.

47. The system of claim 46 further comprising an envelope preparation device in operable communication with said opening device.

48. The system of claim 46 wherein said control device includes at least one nonvolatile storage medium for storing said digital image in a database for subsequent remittance processing.

49. The system of claim 48 wherein said control device further includes a microprocessor with said at least one nonvolatile storage medium operational thereon, operably connected to at least said milling device and said image acquisition device.

50. The system of claim 46 wherein said control device comprises first and second microprocessor control devices each having control logic operational thereon, said first microprocessor control device operably connected to at least said milling device and said second microprocessor control device operably connected to at least said image acquisition device.

51. The system of claim 50 wherein said control logic operating on said first microprocessor device comprises software, whereby when the contents are extracted from one envelope, said milling device is instructed to open a next envelope.

52. The system of claim 51 further including a detection device that determines when the contents are extracted from said envelope.

53. The system of claim 52 wherein said control logic operating on said second microprocessor device comprises software, whereby said image of the contents are acquired and stored in digital form in a file.

54. The system of claim 53 further including an operational control device operable connected to at least said second microprocessor control device, whereby when said image of the contents are acquired and store in digital form in said file, said operational control device is activated and said file is closed.

55. The system of claim 54 herein said operational control device comprises a foot pedal.

56. The system of claim 54 wherein said second microprocessor control device further includes at least one nonvolatile storage medium operational thereon for storing said images in a database for subsequent remittance processing.

57. The system of claim 54 wherein said image acquisition device comprises at least one optical reader for acquiring images of the contents.

58. The system of claim 52 wherein said at least one optical reader comprises a page scanner.

59. The system of claim 57 wherein said at least one optical reader comprises a remittance document scanner.

60. The system of claim 59 wherein said at least one optical reading further comprises a page scanner.

61. The system of claim 59 wherein said remittance document scanner comprises a magnetic image character reader.

62. The system of claim 57 further comprising an alphanumeric keypad operably connected to at least said control device for data entry.

63. The system of claim 57 further comprising a verification device, whereby the envelopes are scanned to verify all the contents have been extracted.

64. A method for processing the contents of a plurality of envelopes, comprising:

opening the envelopes on at least two edges forming opened envelopes and exposing the contents thereof;

extracting said exposed contents;

acquiring an image of said extracted contents and storing said image in digital form; and controlling said opening, providing and acquiring steps using a control device including control logic, whereby said image of the contents are acquired from one envelope and a next envelope is opened; and detecting a mis-scanned image, deleting the mis-scanned image and reacquiring an image of the contents.

65. The method of claim 64 including assigning all the contents extracted from one envelope into a single distinct transaction.

66. The method of claim 64 including opening the envelopes on at least two sides forming envelope panels.

67. The method of claim 66 further including providing at least a partial crease along a line of at least one of said envelope panels and deforming said panel.

68. The method of claim 67 further including clamping said opened envelopes in a clamping device between which the opened envelopes are disposed.

69. A system for processing the contents of a plurality of envelopes, comprising:

a milling device for opening the envelopes on at least two edges forming opened envelopes, and exposing the contents thereof for extraction;

an image acquisition device in operable communication with said milling device to acquire an image of the contents and store said image in digital form in a file; and a control device including control logic operably connected to at least said milling device and said image acquisition device, whereby when said image of the contents are acquired from one envelope, a next envelope is opened by said milling device and a new file is created; wherein said control device assigns all the contents from one envelope into a single distinct transaction;

said milling device opens the envelopes on at least a leading edge and a longitudinal edge;

said milling device includes an extraction device, whereby the contents are exposed for extraction;

said extraction device comprises a clamping device between which said envelopes are disposed;

said clamping device comprises opposed elongated folder blades pivoted upon a first common axis between which said envelopes are disposed;

said folder blades each include an envelope panel engagement edge which are aligned when said envelope panel engagement edges engage opposite sides of said envelopes;

said clamping device further comprises opposed elongated grasping members disposed parallel to said folder blades and pivotable upon a second axis and between which said envelopes are disposed; and an envelope transport device in operable communication with at least said milling device for serially delivering said opened envelopes so that the contents may be extracted; wherein said control device includes at least one nonvolatile storage medium for storing said digital image in a database for subsequent remittance processing;

said control device further includes a microprocessor with said at least one nonvolatile storage medium operational thereon, operably connected to at least said milling device and said image acquisition device;

said control logic comprises software, whereby when said image of the contents are acquired from one envelope, a next envelope is opened by said milling device and a new file is created; and an operational control device operably connected to at least said control device, whereby a mis-scanned image may be corrected.

70. The system of claim 69 wherein said operational control device comprises a foot pedal connected to at least said microprocessor, whereby when said foot pedal is activated, said image in said database is deleted, an image of the contents is reacquired and a new digital image is stored.

* * * * *